US008305328B2

(12) United States Patent
Weng

(10) Patent No.: US 8,305,328 B2
(45) Date of Patent: Nov. 6, 2012

(54) MULTIMODE SOURCE DRIVER AND DISPLAY DEVICE HAVING THE SAME

(75) Inventor: Meng-Tse Weng, Tainan (TW)

(73) Assignee: Himax Technologies Limited, Tainan (TW)

( * ) Notice: Subject to any disclaimer, the term of this patent is extended or adjusted under 35 U.S.C. 154(b) by 612 days.

(21) Appl. No.: 12/509,275

(22) Filed: Jul. 24, 2009

(65) Prior Publication Data

US 2011/0018792 A1 Jan. 27, 2011

(51) Int. Cl.
*G09G 3/36* (2006.01)

(52) U.S. Cl. ..... 345/100; 345/204; 345/99; 345/205; 345/206; 327/333

(58) Field of Classification Search ..... 345/76, 345/82, 87, 94, 98, 99, 100, 204–206, 211–213, 345/690, 698; 327/108, 333
See application file for complete search history.

(56) References Cited

U.S. PATENT DOCUMENTS 4,724,433 A * 2/1988 Inoue et al. ..... 345/208
5,523,773 A * 6/1996 Arakawa et al. ..... 345/98
7,173,596 B2 * 2/2007 Toriumi et al. ..... 345/98
7,190,358 B2 * 3/2007 Hiroki ..... 345/204
7,221,197 B2 5/2007 Morita
7,274,359 B2 * 9/2007 Park ..... 345/204
7,355,459 B2 4/2008 Miyazawa
7,804,338 B2 9/2010 Nagumo
7,940,242 B2 * 5/2011 Lin ..... 345/99
7,973,572 B2 7/2011 Chang
7,973,755 B2 * 7/2011 Morita et al. ..... 345/98
2009/0278779 A1 * 11/2009 Liu et al. ..... 345/98
2010/0259522 A1 * 10/2010 Weng et al. ..... 345/208
2011/0234262 A1 * 9/2011 Weng ..... 327/108

* cited by examiner

*Primary Examiner* — Lun-Yi Lao
*Assistant Examiner* — Tom Sheng
(74) *Attorney, Agent, or Firm* — Baker & McKenzie LLP

(57) ABSTRACT

A multimode source driver for driving a display device in provided, including a bus swapping circuit, connecting a first data bus to one of first and second internal buses and connecting a second data bus to the other one of the first and second internal buses according to a swapping control signal, a start pulse swapping circuit, receiving a first start pulse and a second start pulse to provide a first swap start pulse and a second swap start pulse according to the swapping control signal, a first shift register, triggered by the first swap start pulse to generate a first series of latch signals, a second shift register, triggered by the second swap start pulse to generate a second series of latch signals, a shift multiplexer, outputting a third series of latch signals by selecting the first series and second series of latch signals, a plurality of latch multiplexers, each configured to selectively transmit pixel data from the first or second internal bus according to a mode control signal, a plurality of latch units, configured to latch the pixel data from the latch multiplexers, and an output unit, configured to provide a plurality of driving voltages.

18 Claims, 22 Drawing Sheets

| Output Mode | | | Swapping Control Singal | Mode Control Singal |
|---|---|---|---|---|
| 1 | U | AAAA | 0 | (0,0,0,0) |
| | L | AAAA | 0 | (0,0,0,0) |
| 2 | U | AABB | 0 | (0,0,1,1) |
| | L | BBAA | 0 | (1,1,0,0) |
| 3 | U | ABAB | 0 | (0,1,0,1) |
| | L | BABA | 0 | (1,0,1,0) |

FIG.5

| Output Mode | | | Swapping Control Singal | Mode ControlSingal |
|---|---|---|---|---|
| 1 | U | AAAA | 0 | (0,0,0,0) |
| | L | AAAA | 0 | (0,0,0,0) |
| 2 | U | AABB | 0 | (0,0,1,1) |
| | L | BBAA | 1 | (1,1,0,0) |
| | | | 0 | (0,0,1,1) |
| 3 | U | ABAB | 0 | (0,1,0,1) |
| | L | BABA | 0 | (1,0,1,0) |

FIG.10

MULTIMODE SOURCE DRIVER AND DISPLAY DEVICE HAVING THE SAME

BACKGROUND

1. Technical Field

The embodiments described herein relate to a display device, and more particularly, to a multimode source driver and a display device employing the multimode source driver.

2. Related Art

Liquid crystal display (LCD) devices have been widely used in portable electronic apparatuses such as cellular phones and other portable devices. An LCD driver is commonly composed of source drivers, gate drivers, and a timing controller. Low power consumption and high display quality have been an unceasing pursuit of all LCD devices.

Typically, liquid crystal display panels are driven according to an inversion driving method (e.g., a frame inversion method, a line (or column) inversion method, or a dot inversion method) to improve display quality as well as to prevent liquid crystal material from deteriorating. Advantageously, driving the LCD panel according to the dot inversion method may improve the picture quality of the LCD panels compared to the other inversion methods, because flicker occurring in both horizontal and vertical directions can offset each other. However, power dissipation of the LCD panel driven by the dot inversion method is excessively high due to large fluctuation amount of a display data signal applied by the source driver.

Recently, a Z-inversion display panel is proposed, which may have display quality similar to that provided by the dot inversion method, while the power consumption of the source driver can be remarkably reduced compared to that of LCD panels driven according to the dot inversion method.

On the other hand, the source driver also plays a particularly critical role for achieving demand for low-power dissipation and high-speed LCD devices. Various source drivers have been developed to meet many design constraints such as driving capability and driving speed for large loads of the display panel and low power consumption. However, in many situations where the load on the display panel is excessively high, dual source-drivers are required to be disposed on two sides of a display panel to have mitigated loading from the display panel.

It is thus highly desired to design a source driver that not only meets those design constrains but also has high adaptability to various display types, particularly Z-inversion display panels, for achieving power consumption, and to dual source driver configurations, for achieving load mitigation.

SUMMARY

A multimode source driver for a display device that can operate in different modes to provide an improved driving speed and high adaptability to various display panel types and dual source driver configurations, and a display device having the multimode source driver, and a driving method for driving a display device are described herein.

In one aspect, a multimode source driver is connected to a first data bus and a second data bus for driving a display device. The multimode source driver includes a bus swapping circuit, connecting the first data bus to one of a first internal bus and a second internal bus, and connecting the second data bus to the other one of the first internal bus and the second internal bus, according to a swapping control signal, a start pulse swapping circuit, receiving a first start pulse and a second start pulse to provide a first swap start pulse and a second swap start pulse according to the swapping control signal, a first shift register, triggered by the first swap start pulse to generate a first series of latch signals, a second shift register, triggered by the second swap start pulse to generate a second series of latch signals, a shift multiplexer, receiving the first series of latch signals and the second series of latch signals and outputting a third series of latch signals by selecting the first series of latch signals and the second series of latch signals, a plurality of latch multiplexers, each coupled to the first internal bus and the second internal bus, and each configured to selectively transmit pixel data from the first internal bus or the second internal bus according to a mode control signal, a plurality of latch units, controlled by the third series of latch signals to latch the pixel data from the latch multiplexers, an output unit, configured to provide a plurality of driving voltages according to the pixel data from the latch units.

In another aspect, a display device include a display panel, a first multimode source driver disposed on one side of the display panel for driving the display panel, and a second multimode source driver disposed on the other side of the display panel for driving the display panel.

These and other features, aspects, and embodiments are described below in the section entitled "Detailed Description."

BRIEF DESCRIPTION OF THE DRAWINGS

Features, aspects, and embodiments are described in conjunction with the attached drawings, in which:

FIG. 5 is a table that summarizes the output modes of the multimode source drivers and the corresponding states of swapping control signals and mode control signals for FIGS. 3A-3C and FIGS. 4A-4C;

FIG. 10 is a table that summarizes the output modes of the multimode source drivers and the corresponding states of swapping control signals and mode control signals for FIGS. 8A-8C and FIGS. 9A-9C;

DETAILED DESCRIPTION

Figure 1:
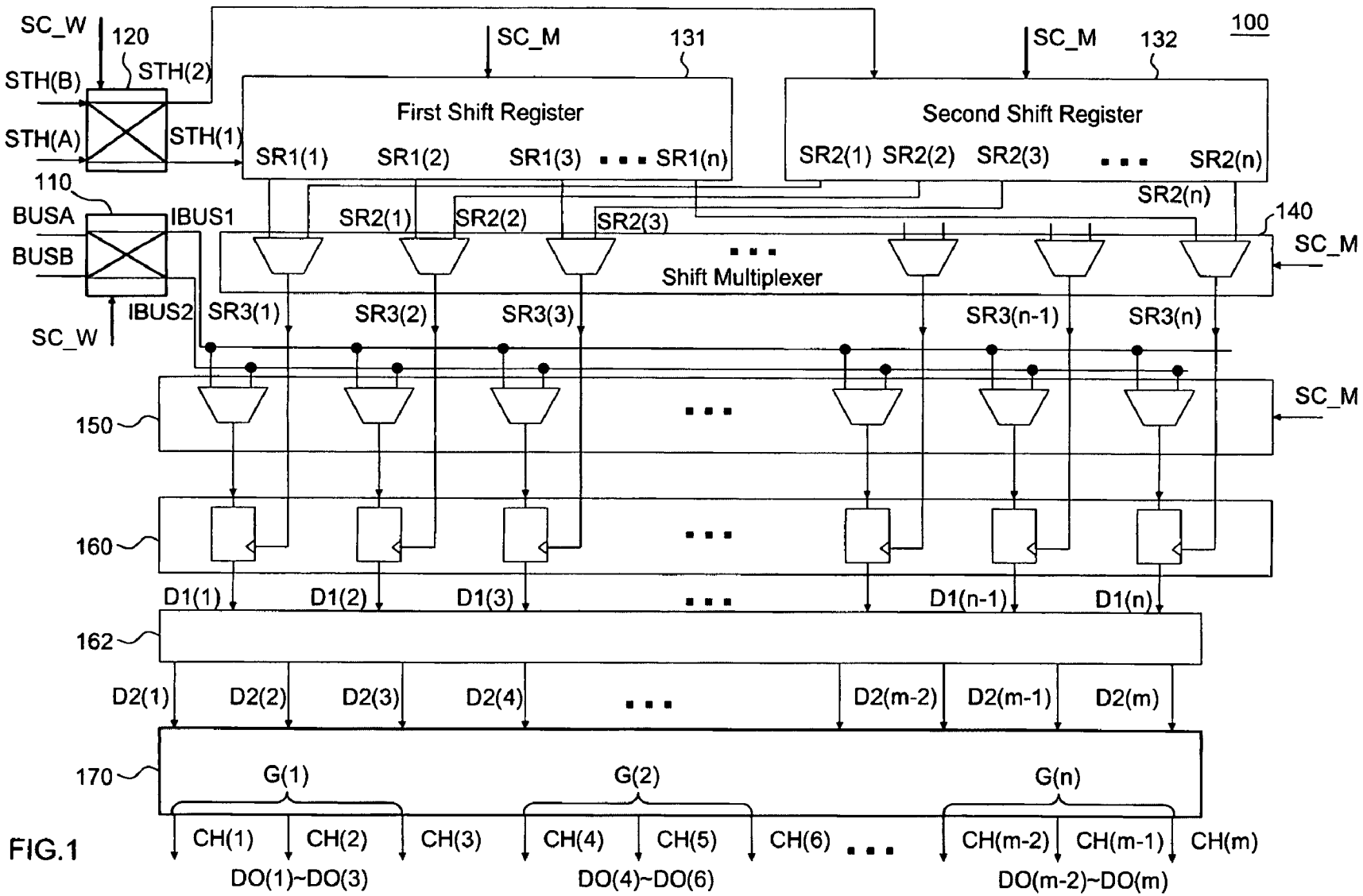
FIG. 1 is a schematic diagram of a multimode source driver in accordance with one embodiment.

FIG. 1 is a schematic diagram of a multimode source driver in accordance with one embodiment. The multimode source driver 100, connected to a first data bus 'BUSA' and a second data bus 'BUSB', can be configured to process pixel data transmitted on the first data bus 'BUSA' and the second data bus 'BUSB' from a timing controller (not shown) and provide a plurality of driving voltages 'DO(1)'-'DO(m)' respectively through a plurality of output channels 'CH(1)'-'CH(m)' (wherein m is a non-zero integer) to drive corresponding pixels on a display panel (not shown).

The output channels 'CH(1)'-'CH(m)' can be grouped into channel groups 'G(1)'-'G(n)' (wherein n is a non-zero integer), and each channel group includes at least one output channel. Preferably, as shown in the figure, each channel group includes three output channels respectively for driving blue, green, and red pixels (i.e., m=3n). That is, the channel groups 'G1', 'G2', . . . , 'Gn' include output channels 'DO(1)'-'DO(3)' 'DO(4)'-'DO(6)', . . . , 'DO(m−2)'-'DO(m)', respectively.

Additionally, the timing controller can transmit pixel data via the first data bus 'BUSA' and the second data bus 'BUSB' according to a transmission mode. In an embodiment the transmission modes of the timing controller can include M1M2M3M4=AAAA, AABB, and ABAA modes. When the transmission mode is AAAA, the timing controller transmits pixel data via the first data bus 'BUSA' only. When the transmission mode is AABB, the timing controller transmits first pixel data and second pixel data via the first data bus 'BUSA' and transmits the third pixel data and the fourth pixel data via the second data bus 'BUSB', and then transmits the subsequent pixel data according to the same sequence. When the transmission mode is ABAB, the timing controller transmits first pixel data and third pixel data via the first data bus 'BUSA' and transmits the second pixel data and the fourth pixel data via the second data bus 'BUSB', and then transmits the subsequent pixel data according to the same sequence.

The multimode source driver 100, instructed by the timing controller, can then fetch the pixel data transmitted on the first and second data buses 'BUSA', 'BUSB' and provide the driving voltages 'DO(1)'-'DO(m)' according to an output mode corresponding to the transmission mode of the timing controller.

The multimode source driver 100 can then determine, according to its output mode, whether to provide the pixel data received from the first data bus 'BUSA' or the pixel data received from the second data bus 'BUSB' to each channel group 'Gi' (i is any integer between 1 and m). The driving voltage provided to each channel group 'Gi' can be either the pixel data received from the first data bus 'BUSA' or the pixel data received from the second data bus 'BUSB'. In other words, the multimode source driver 100 can re-arrange the sequence of the pixel data input from the timing controller in different ways so as to provide the driving voltages according to different output modes.

In an specific embodiment with n=4, the input modes can include M1M2M3M4=AAAA, AABB, and ABAB modes. If Mi=A (wherein i=1~4), the multimode source driver 100 provides pixel data received from the first data bus 'BUSA' to the channel group 'Gi'; and if Mi=B, the multimode source driver 100 provides pixel data received from the second data bus 'BUSB' to the channel group 'Gi'.

As shown in FIG. 1, the multimode source driver 100 can comprise a bus swapping circuit 110, a start pulse swapping circuit 120, a first shift register 131 and a second shift register 132, a shift multiplexer 140, a plurality of latch multiplexers 150, a plurality of latch units 160, and an output unit 170. Preferably, the multimode source driver 100 can further comprise a latch unit 162 coupled between the latch units 160 and the output unit 170. Additionally, the multimode source driver 100 can be set by a mode control signal SC_M and a swapping control signal SC_W received from the timing controller to selectively operate in one of a plurality of output modes.

The bus swapping circuit 110, coupled between the timing controller and the latch multiplexers 150, can be configured to receive pixel data transmitted on the first and second data buses 'BUSA', 'BUSB' and provide the received pixel data to the latch multiplexers 150. Additionally, the bus swapping circuit 110 can further receive the swapping control signal 'SC_W' from the timing controller. The bus swapping circuit 110 can connect the first data bus 'BUSA' to one of a first internal bus 'IBUS1' and a second internal bus 'IBUS2', and connecting the second data bus 'BUSB' to the other one of the first internal bus 'IBUS1' and the second internal bus 'IBUS2', according to the swapping control signal 'SC_W'. The start pulse swapping circuit 110, for example, can be implemented as a multiplexer.

Specifically, if the swapping control signal 'SC_W' is at a first state (e.g. at a low state or '0'), then the bus swapping circuit 110 connects the first data bus 'BUSA' to the first internal bus 'IBUS1' and connects the second data bus 'BUSB' to the second internal bus 'IBUS2'. Otherwise, if swapping control signal 'SC_W' is at a second state (e.g. at a high state or '1'), then conversely, the bus swapping circuit 110 connects the first data bus 'BUSA' to the second internal bus 'IBUS2' and connects the second data bus 'BUSB' to the first internal bus 'IBUS2'.

The start pulse swapping circuit 120, coupled between the timing controller and the first and second shift registers 131 and 132, can be configured to receive a first start pulse STH(A) and a second start pulse STH(B) from the timing controller and provide a first swap start pulse STH(1) and a second swap start pulse STH(2) to the first and second shift registers 131 and 132 according to the swapping control signal 'SC_W'.

The start pulse swapping circuit 120, controlled by the swapping control signal 'SC_W', can be required to operate correspondingly to the bus swapping circuit 110. Specifically, if the swapping control signal 'SC_W' is at a first state (e.g. at a low state or '0'), then the start pulse swapping circuit 120 does not perform swapping on the first and second start pluses STH(A), STH(B), which are directly provided as the first and second swap start pulses 'STH(1)' and 'STH(2)', respectively. Otherwise, if the swapping control signal 'SC_W' is at a second state (e.g. at a high state or '1'), then the start pulse swapping circuit 120 performs swapping on the first and second start pluses STH(A), STH(B), which are instead provided as the second and first swap start pulses 'STH(2)' and 'STH(1)', respectively.

The first shift register 131, coupled between the start pulse swapping circuit 120 and the shift multiplexer 140, can be triggered by the first swap start pulse STH(1) to sequentially generate a first series of latch signals SR1(1)-SR1(*n*) according to the mode control signal SC_M.

Similarly, the second shift register 132, coupled between the start pulse swapping circuit 120 and the shift multiplexer 140, can be triggered by the second swap start pulse STH(2) to sequentially generate a second series of latch signals SR2(1)-SR2(n) according to the mode control signal SC_M. The first and second shift registers 131 and 132, for example, can each include a group of flip-flops for performing shifting operation.

The shift multiplexer 140, coupled between the first and second shift registers 141 and 142 and the latch multiplexers 150, is configured to receive the first series of latch signals SR1(1)-SR1(n) and the second series of latch signals SR2(1)-SR2(n) and then output a third series of latch signals SR3(1)-SR3(n) by selecting the first series of latch signals SR1(1)-SR1(n) and the second series of latch signals and SR2(1)-SR2(n). Specifically, the multiplexer array 143, for example, can include a plurality of multiplexers as shown in FIG. 1. Each of the multiplexers can select one of a corresponding first latch signal SR1(i) and a corresponding second latch signal SR2(i) (wherein i=1~n) as a corresponding third latch signal SR3(i) in response to the mode control signal SC_M.

As an example, the mode control signal 'SC_M' is denoted as (S1, S2, . . . , Sn), which means that if Si=0, then the ith one of the multiplexers within the shift multiplexer transmits the ith one of the first series of latch signals 'SR1(i)' as the ith one of the third series of latch signals 'SR3(i)', and if Si=1, the multiplexer 14(i) transmits the second latch signal 'SR2(i)' as the ith one of the third series of latch signals 'SR3(i)'.

Each of the plurality of latch multiplexers 150, coupled to the first internal bus IBUS1 and the second internal bus IBUS2, can be configured to selectively transmit pixel data from the first internal bus IBUS1 or pixel data from the second internal bus IBUS2 according to the mode control signal SC_M.

Additionally, the latch multiplexers 150 and the multiplexers within the shift multiplexer 140 can be required to operate correspondingly such that they can transmit corresponding pixel data and third series of latch signals to the latch units 160. As an example, the mode control signal 'SC_M' can be denoted as (S1, S2, . . . , Sn), which means that, if Si=0, the ith one (wherein i=1~n) of the latch multiplexers 150 transmits pixel data from the first internal bus IBUS1 to a corresponding one of the latch units 160; if Si=1, the ith one of the latch multiplexers transmits pixel data from the second internal bus IBUS2 to a corresponding one of the latch units 160.

The plurality of latch units 160 is controlled by the third series of latch signals SR3(1)-SR3(n) to latch the pixel data from the latch multiplexers 140, so as to provide a plurality of pixel data D1(1)-D1(n). Specifically, each of the latch units 160 can be triggered by a corresponding one of the latch signals SR3(1)-SR3(n) provided by a corresponding multiplexer within the shift multiplexer 140 to capture pixel data provided by a corresponding one within the latch multiplexers 150 and then provide a corresponding one of the pixel data D1(1)-D1(n).

Preferably, the multimode source driver 100 can further include a latch unit 162 coupled to the latch units 160. The latch unit 162 can configured to re-arrange the pixel 'D1(1)'-'D1(n)' received from the latch units 160 to provide a plurality of pixel data 'D2(1)'-'D2(m)' to the output unit 170.

The output unit 170 is configured to provide the driving voltages 'DO(1)'-'DO(m)' respectively through the output channels 'CH(1)'-'CH(m)' according to the pixel data 'D1(1)'-'D1(n)' received from the latch units 160, which, preferably, has been re-arranged as pixel data 'D2(1)'-'D2(m)' by the latch unit 162. As an example, the output unit 170 can include a digital-to-analog converter (DAC) to convert the pixel 'D2(1)'-'D2(m)' into analog signals, and an output buffer to amplify and output the analog signals.

An important feature of the embodiment is that the bus swapping circuit 110 and the start pulse swapping circuit 120 that are controlled by the swapping control signal 'SC_W' can make the pixel data input from the data buses 'BUSA' and 'BUSB' and the start pulses 'STH(A)' and 'STH(B)' swappable. Another important feature of the embodiment is that the shift multiplexer 140 and the latch multiplexers 150 that are controlled by the mode control signal 'SC_M' can selectively transmit the pixel data on the internal buses IBUS1 and IBUS2 and the first series and second series of latch signals SR1 and SR2. With such an implementation, the multimode source driver 100 can rearrange the sequence of the input pixel data in different ways so as to provide the driving voltages according to different output modes as specified by the mode control signal 'SC_M' and the swapping control signal 'SC_W'.

In an exemplary case with n=4, if the mode control signal 'SC_M' (denoted as (S1, S2, S3, S4)) is set as '(0, 0, 1, 1)' and the swapping control signal 'SC_W' is '0', then the multimode source driver 100 operates in output mode 'AABB'. If the mode control signal 'SC_M' is maintained as '(0, 0, 1, 1)' while the swapping control signal 'SC_W' is charged to '1', then the multimode source driver 100 change to operate in output mode 'BBAA'.

Because the source drive can simultaneously receive pixel data from two data buses 'BUSA' and 'BUSB', the speed of the multimode source driver 100 to drive the display panel can be improved. Moreover, the multimode source driver 100 can have adjustable speeds to drive the display panel because it can operate in different output modes.

Additionally, due to the ability to selectively operate in different modes, the multimode source driver 100 can be readily employed in diverse applications. For example, the multimode source driver 100 can be applied to various display panel types, thus providing desired advantages of these display panel types. For another example, two multimode source drivers, if set in appropriate output modes, can cooperate to drive the same display panel, each thus having mitigated loading from the display panel. Furthermore, the multimode source driver can operate with comparable output modes in driving various display panel types, thus can have simple control mechanisms. These advantages are demonstrated below with several embodiments.

First Embodiment

Dual Multimode Source Drivers Each Having 12N Output Channels

In the embodiment, two multimode source drivers are applied to drive the same display panel that requires to be driven by 12N output channels (that is, m=12N, where N is a non-zero integer). Accordingly, every twelve output channels (i.e. every four channel groups for m=3n) can be allocated as one channel base. Because the multimode source driver has four output channels in every channel base, the output modes can therefore include modes $M_1M_2M_3M_4$=AAAA, AABB, and ABAB. Additionally, the display panel can be driven according to a variety of well-know driving methods, such as frame inversion method, line inversion method, column inversion method, and dot inversion method.

Figure 2A:
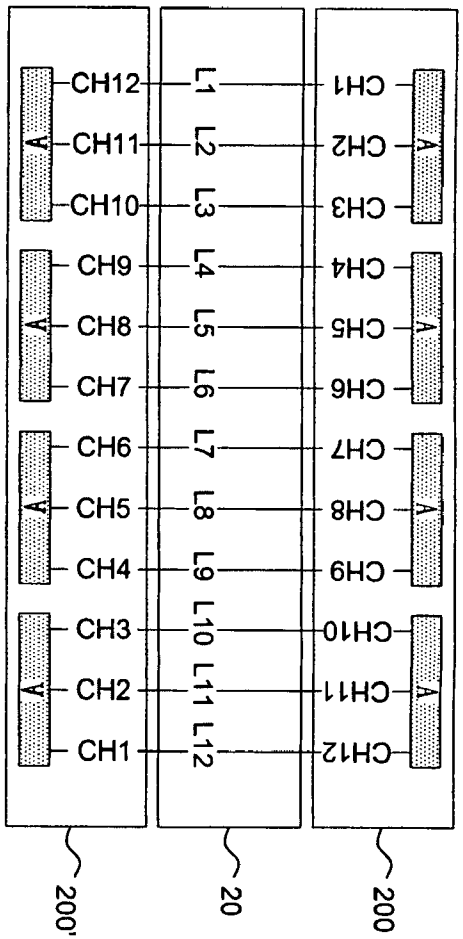
FIGS. 2A-2C are schematic diagrams of a display device that employs two "12N"-type multimode source drivers of FIG. 1 operating in different output modes in accordance with one embodiment.
Figure 2B:
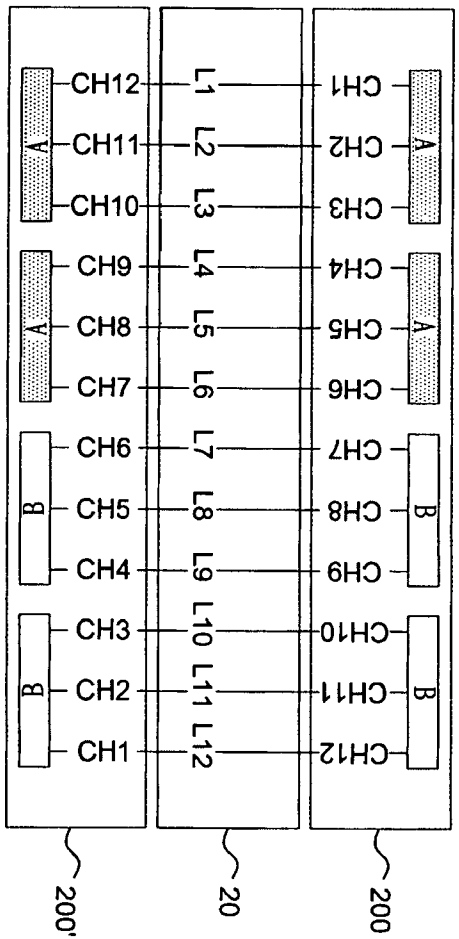
Figure 2C:
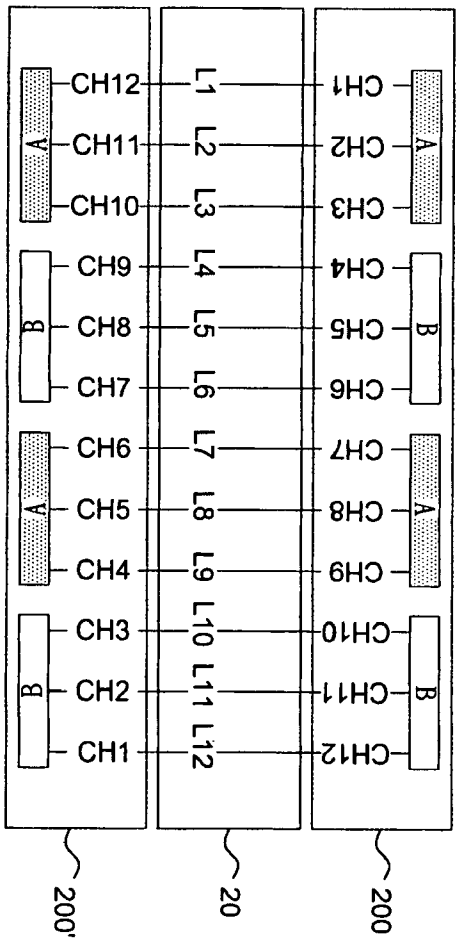

FIGS. 2A-2C are schematic diagrams of a display device that employs two "12N"-type multimode source drivers of FIG. 1 operating in different output modes in accordance with one embodiment, where N is 1 for example. As shown in FIGS. 2A-2C, a display device includes a display panel 20, and two multimode source drivers 200 and 200' that are disposed on two sides of the display panel 20.

As shown in FIG. 2A, the multimode source driver 200 on the upper side of the display panel 20 and the multimode source driver 200' on the lower side on the display panel 20 both operate in the output modes AAAA, which cause source lines L1-L3, L4-L6, L7-L9, and L10-L12 on the display panel 20 to receive pixel data transmitted on the first data bus 'BUSA' in FIG. 1.

As shown in FIG. 2B, the multimode source driver 200 on the upper side operates in the output mode AABB, while the multimode source driver 200' on the lower side operates in the output mode BBAA, such that each source line can be provided by the multimode source drivers 200 and 200' with pixel data transmitted from the same data bus (i.e. the first data bus 'BUSA' or the second data bus 'BUSB' in FIG. 1).

As shown in FIG. 2C, the multimode source driver 200 on the upper side operates in the output mode ABAB, while the multimode source driver 200' on the lower side operates in the output mode BABA, such that each source line can be provided by the multimode source drivers 200 and 200' with pixel data transmitted from the same data bus (i.e. the first data bus 'BUSA' or the second data bus 'BUSB' in FIG. 1).

Figure 3A:
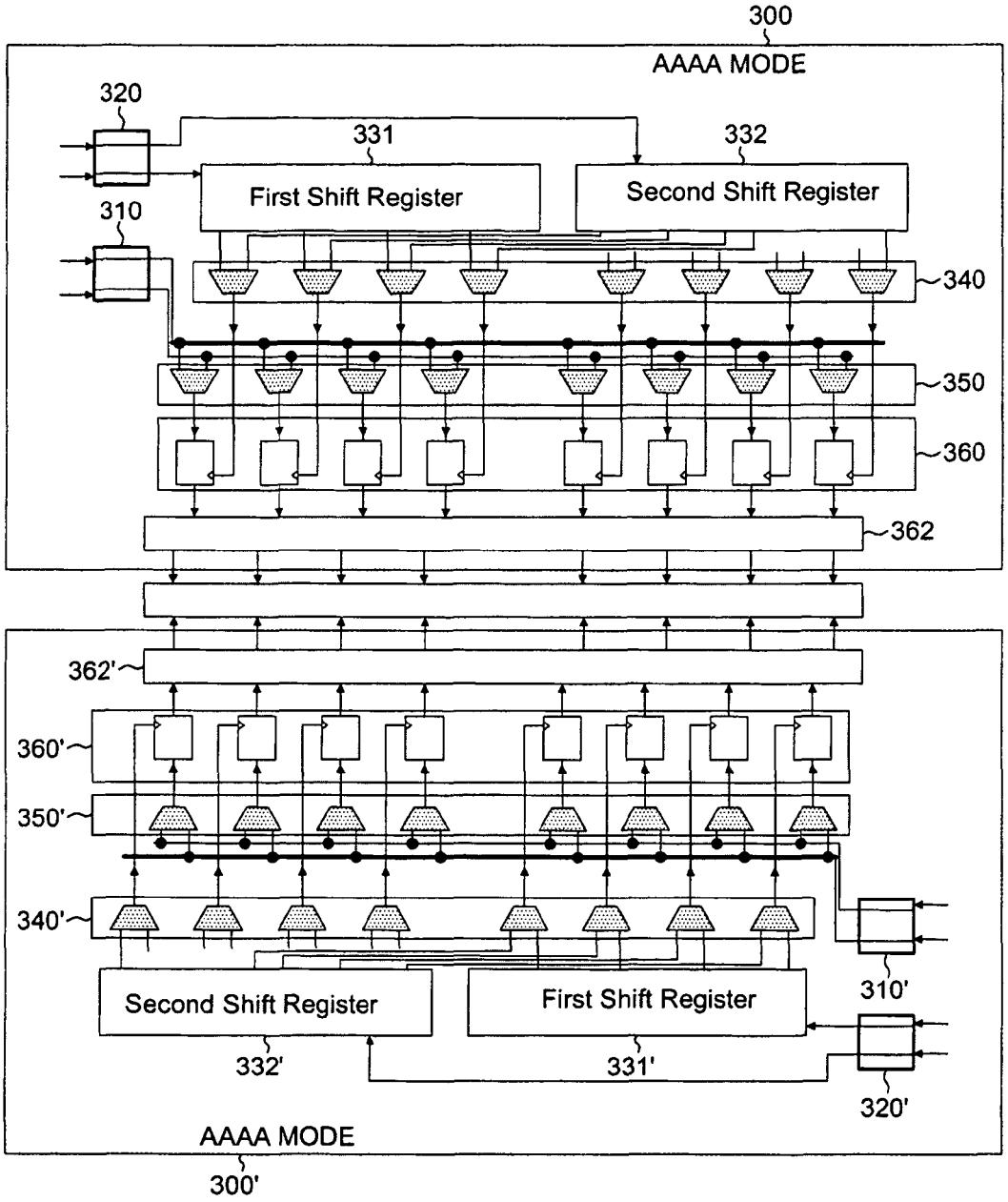
FIGS. 3A-3C are exemplary diagrams illustrating the detailed operation of the two multimode source drivers corresponding to FIGS. 2A-2C, respectively, in accordance with one embodiment.
Figure 3B:
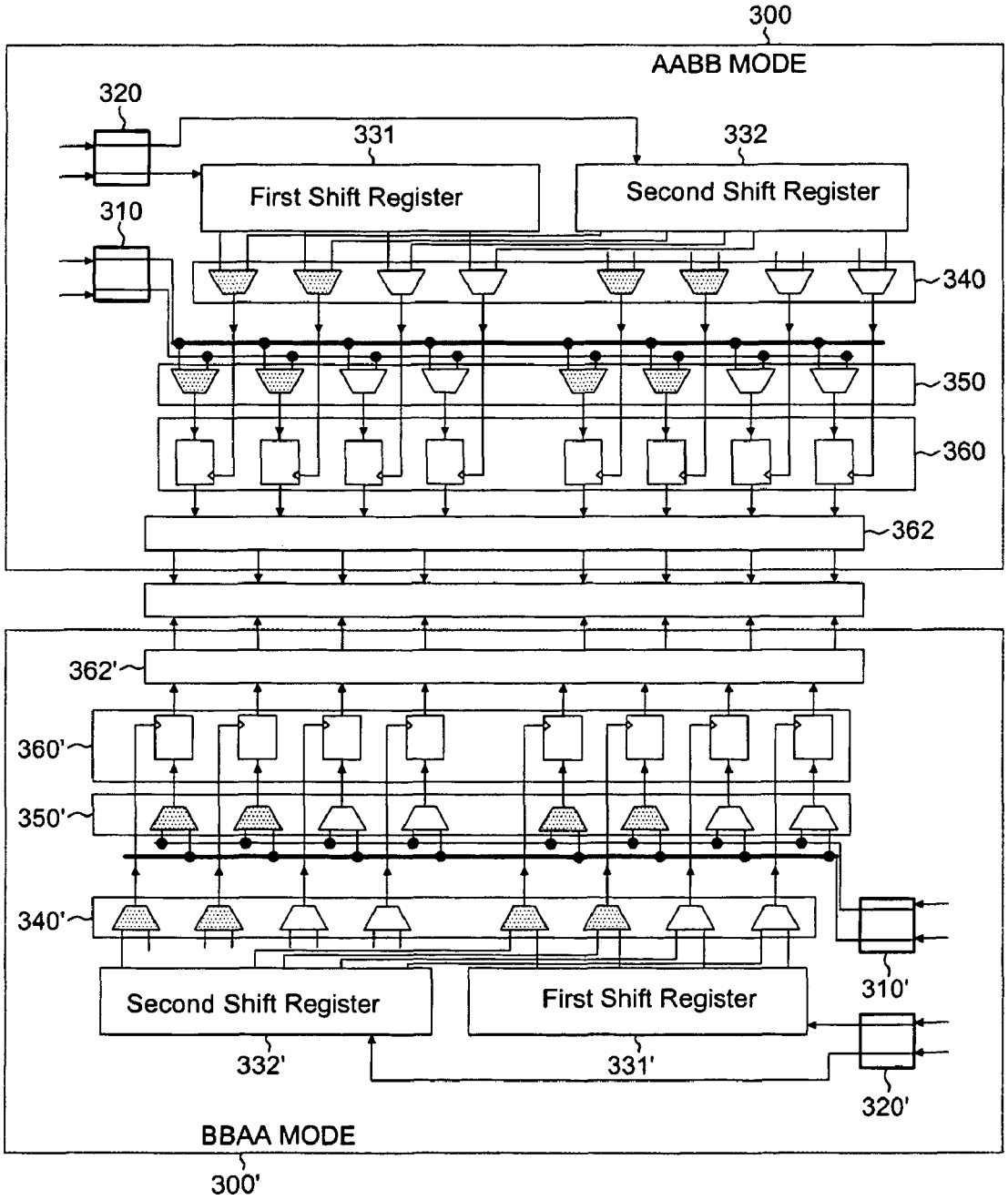
Figure 3C:
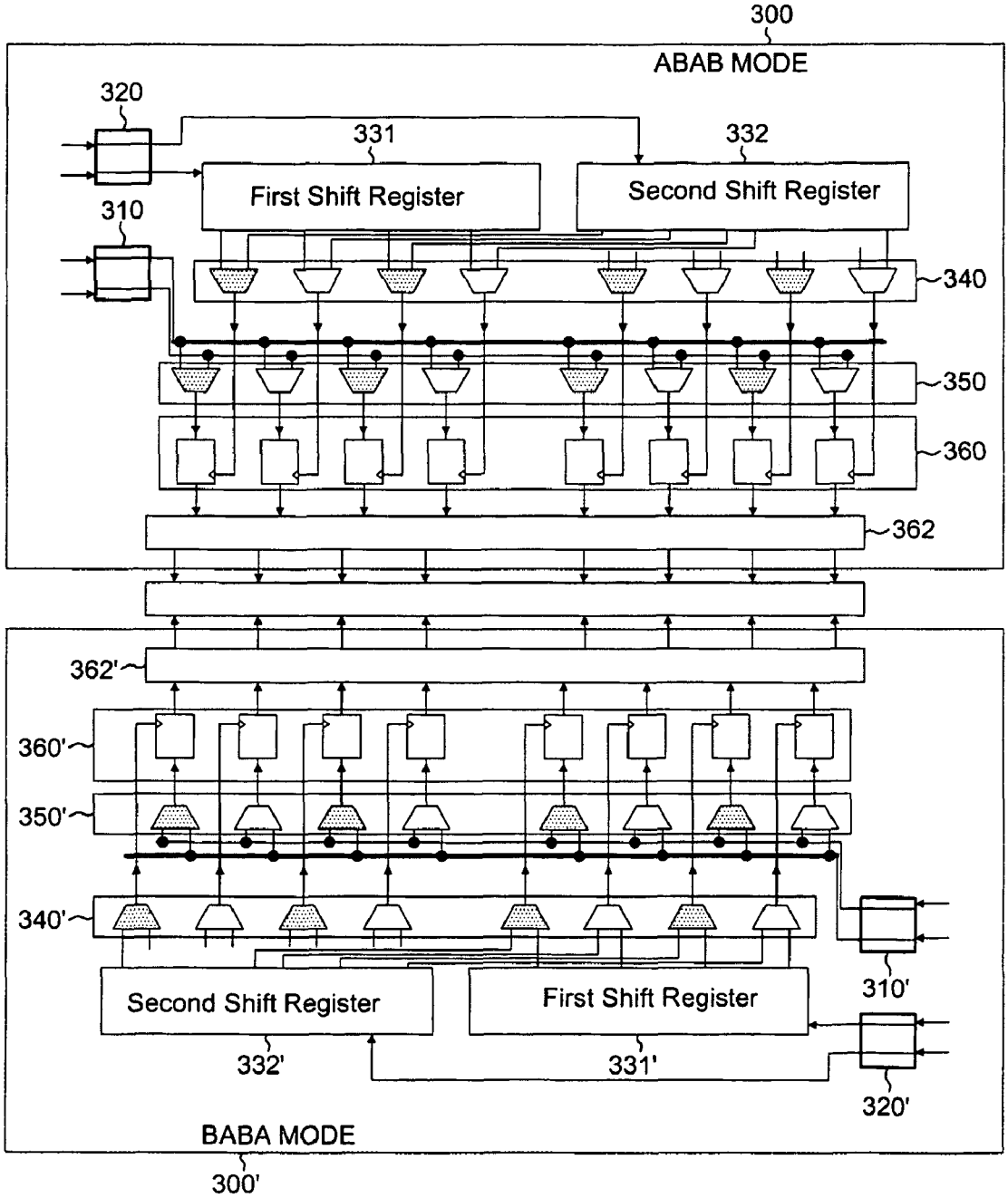

FIGS. 3A-3C are exemplary diagrams illustrating the detailed operation of the two multimode source drivers corresponding to FIGS. 2A-2C, respectively, in accordance with one embodiment where n=8, m=n*3=24, and therefore m=6*4 (i.e., N=4).

In the illustrative embodiment of FIG. 3A-3C, output units are omitted for clearer illustration purpose. Additionally, multiplexers within a shift multiplexer 340 are drawn gray and white to represent they transmit latch signals SR1 and SR2, respectively. Additionally, latch multiplexers 350 are drawn gray and white to represent they transmit pixel data from internal bus 'BUS 1' and 'BUS2', respectively.

FIG. 5 is a table that summarizes the output modes of the multimode source drivers 300 and 300', and the corresponding states of the swapping control signals and the mode control signals for FIGS. 3A-3C and FIGS. 4A-4C.

Figure 4A:
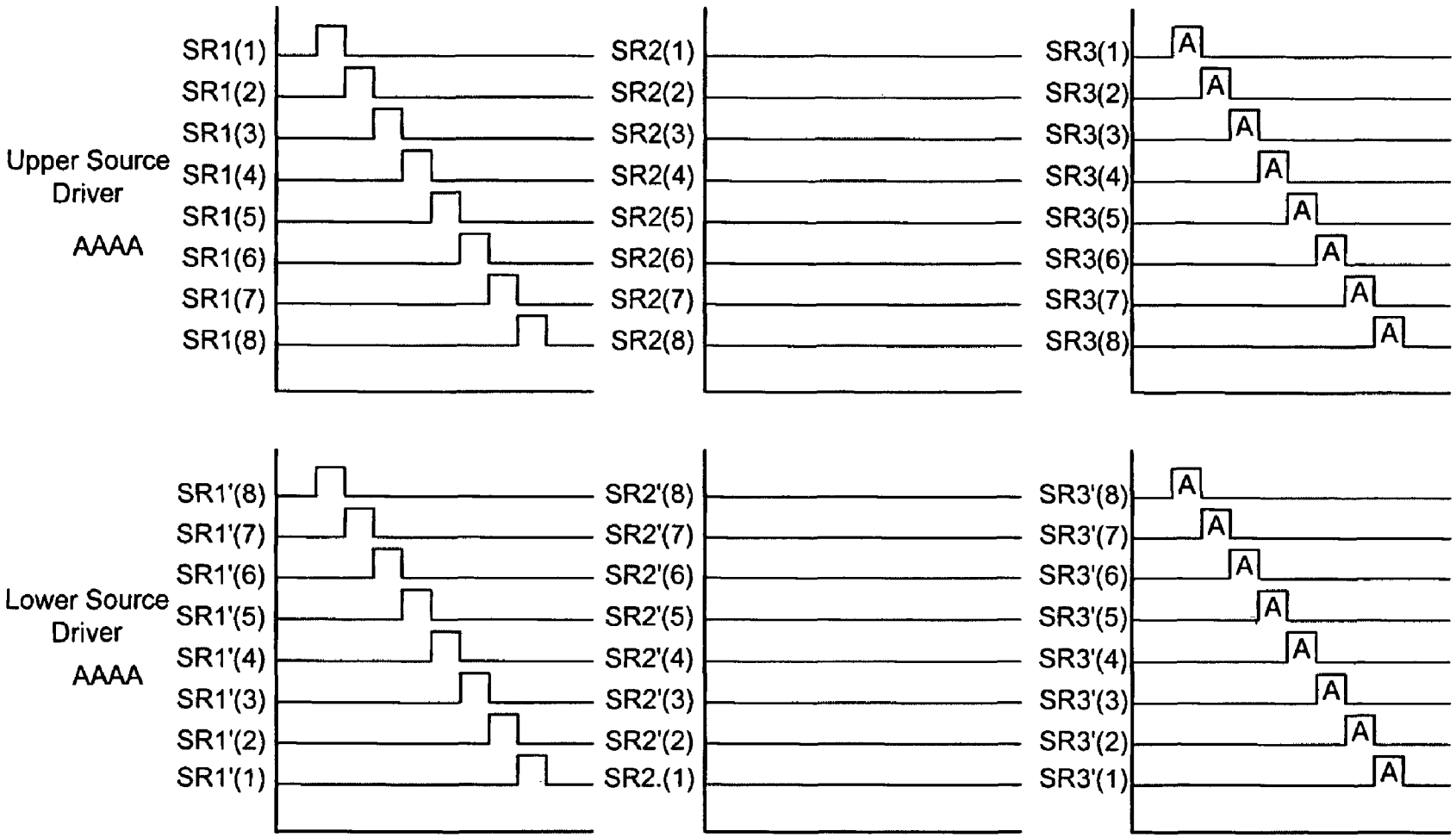
FIGS. 4A-4C are exemplary timing diagrams illustrating the waveforms of typical latch signals in FIGS. 3A-3C, respectively, in accordance with one embodiment.

In FIGS. 3A, 4A, and 5, two multimode source drivers 300 and 300', both operating in output modes AAAA, receive the swapping control signals 'SC_W' and "SC'_W' that are both '0' and mode control signals 'SC_M' and 'SC'_M' that are both '(0, 0, 0, 0)'.

Referring particularly to FIG. 4A, illustrated therein are the waveforms of first and second series of latch signals SR1(1)-SR1(8) and SR2(1)-SR2(8) and the third series of latch signals SR3(1)-SR3(8) that are provided to the multimode source driver 300, and the waveforms of the first and second series of latch signals SR1'(1)-SR1'(8) and SR2'(1)-SR2'(8) and the third series of latch signals SR'(i)-SR'(8) that are provided to the multimode source driver 300'.

As shown in FIG. 4A, the first series of latch signals SR1(1)-SR1(8) are sequentially turned on, while the second series of latch signals SR2(1)-SR2(8) are continuously maintained low, which are then selectively transmitted according to the mode control signal 'SC'_M' '(0, 0, 0, 0)' to provide the third series of latch signals SR3(1)-SR3(8) that are turned on in a sequence as SR3(1)=SR1(1)→SR3(2)=SR1(2)→SR3(3)=SR1(3)→ . . . →SR3(8)=SR1(8). On the other hand, the first series of latch signals SR1(1)-SR1(8) and SR1'(1)-SR1'(8) have opposite sequences, that is, SR1'(1)=SR1(8-*i*+1) where 1≦i≦8; and the second series of latch signals SR2(1)-SR2(8) and SR2'(1)-SR2'(8) have opposite sequences, that is, SR2'(*i*)=SR2(8-*i*+1). Consequently, the third series of latch signals SR3(1)-SR3(8) and SR'(1)-SR'(8) also have opposite sequences, that is, SR'(i)=SR3(8-*i*+1), which cause each source line of the display panel to be driven at the same timing.

Figure 4B:
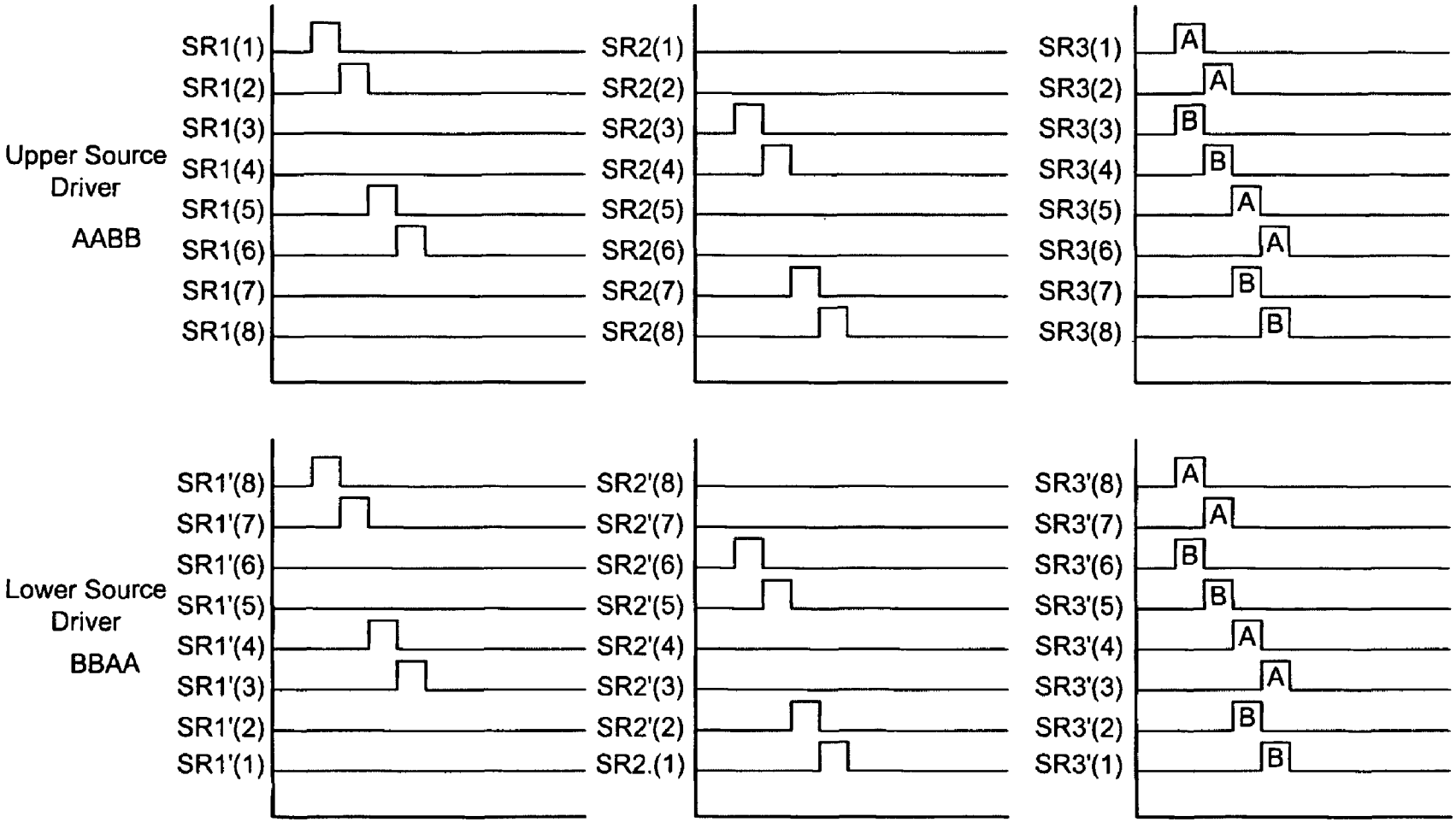

In FIGS. 3B, 4B, and 5, the multimode source drivers 300 and 300', respectively operating in output modes AABB and BBAA, receive the swapping control signals 'SC_W' and "SC'_W' that are both '0' and the mode control signals 'SC'_M' and 'SC'_M' that are '(0, 0, 1, 1)' and '(1,1,0,0)', respectively.

Referring particularly to FIG. 4B, the first and second series of latch signals SR1(1)-SR1(8) and SR2(1)-SR2(8) are turned on in a sequence as: SR1(1) and SR2(3) both on→SR1(2) and SR2(4) both on→SR1(5) and SR2(7) both on→SR1(6) and SR2(8) both on, which are then selectively transmitted according to the mode control signal 'SC'_M' '(0, 0, 1, 1)' to provide the third series of latch signals SR1(1)-SR1(8) that are turned on in a sequence as: SR3(1)=SR1(1) and SR3(3)=SR2(1) both on→SR3(2)=SR1(2) and SR3(4)=SR2(4) both on→SR3(5)=SR1(5) and SR3(7)=SR2(7) both on→SR3(6)=SR1(6) and SR3(8)=SR2(8) both on. On the other hand, SR1'(*i*)=SR1(8-*i*+1), SR2'(*i*)=SR2(8-*i*+1), and SR'(i)=SR3(8-*i*+1) where 1≦i≦8, such that each source line of the display panel can be driven by the multimode source drivers 300 and 300' at the same timing.

Figure 4C:
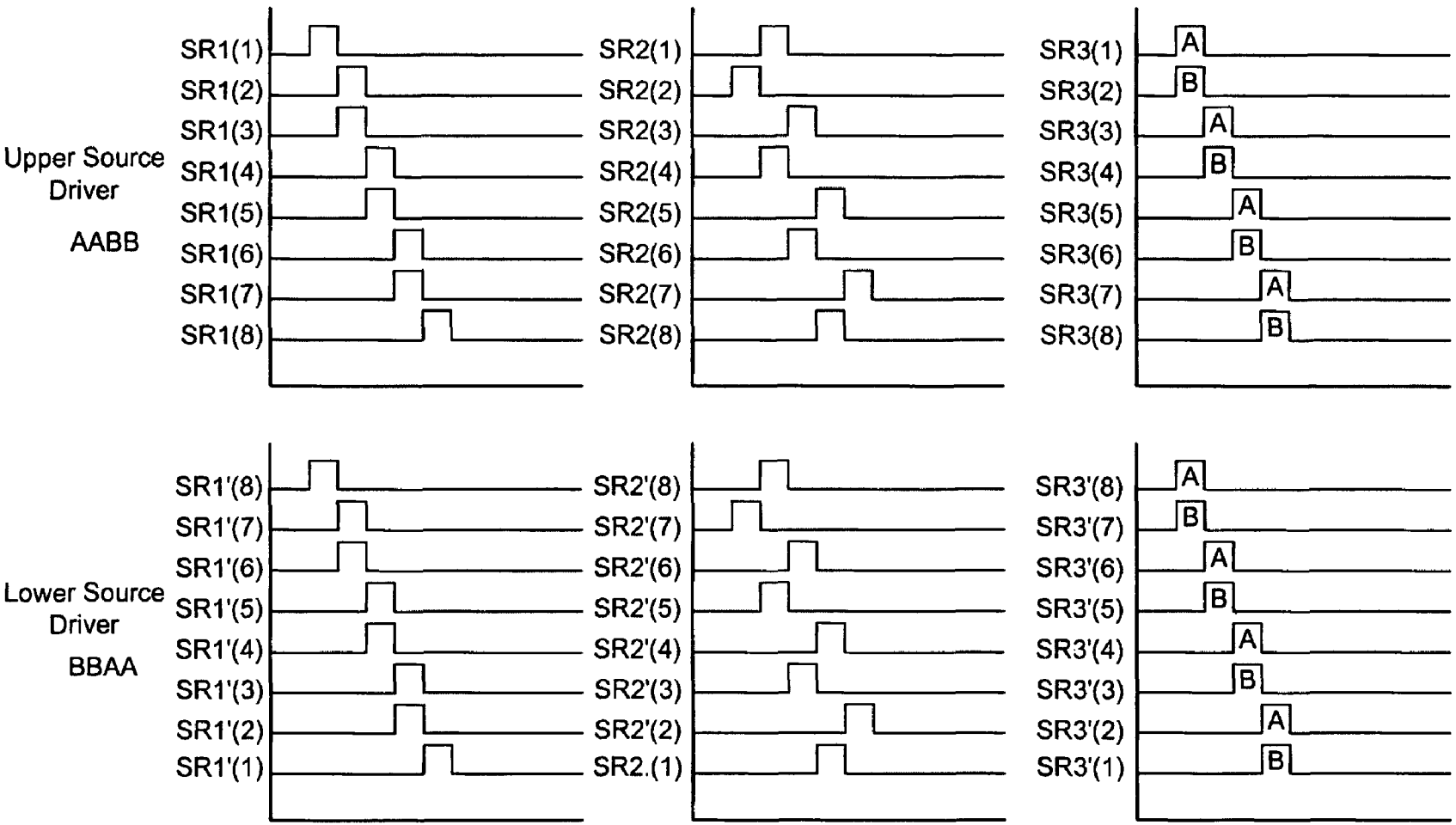

In FIGS. 3C, 4C, and 5, the multimode source driver 300 and 300', respectively operating in output modes ABAB and BABA, receive the swapping control signals 'SC_W' and "SC'_W' that are both '0' and the mode control signals 'SC'_M' and 'SC'_M' that are '(0, 1, 0, 1)' and '(1, 0, 1, 0)', respectively.

Referring particularly to FIG. 4C, the first and second series of latch signals SR1(1)-SR1(8) and SR2(1)-SR2(8) are turned on in a sequence as: SR1(1) and SR2(2) both on→SR1(2), SR1(3), SR2(1), and SR2(4) all on→SR1(4), SR1(5), SR2(3), and SR2(6) all on→SR1(6), SR1(7), SR2(5), and SR2(8) all on→SR1(8) and SR2(7) both on, which are then selectively transmitted according to the mode control signal 'SC'_M' '(0, 1, 0, 1)' to provide the third series of latch signals SR1(1)-SR1(8) that are turned on in a sequence as SR3(1)=SR1(1) and SR3(2)=SR2(2) both on→SR3(3)=SR1(3) and SR3(4)=SR2(4) both on→SR3(5)=SR1(5) and SR3(6)=SR2(6) both on→SR3(7)=SR1(7) and SR3(8)=SR2(8) both on. On the other hand, SR1'(*i*)=SR1(8-*i*+1), SR2'(*i*)=SR2(8-*i*+1), and SR'(i)=SR3(8-*i*+1) for i=1~8, such that each source line of the display panel can be driven by the multimode source drivers 300 and 300' at the same timing.

Second Embodiment

Z-Inversion Type Display Panel Driven by Dual Source Drives Having (12N+6) Output Channels In the embodiment, two multimode source drivers are applied to drive a Z-inversion type display panel in order to further reduce power consumption. Additionally, the output modes of the embodiment can be comparable with those of the first embodiment. That is, every twelve output channels (i.e. every four channel groups) can also be allocated as one channel base and the output modes can also be AAAA, AABB, and ABAB.

Figure 6:
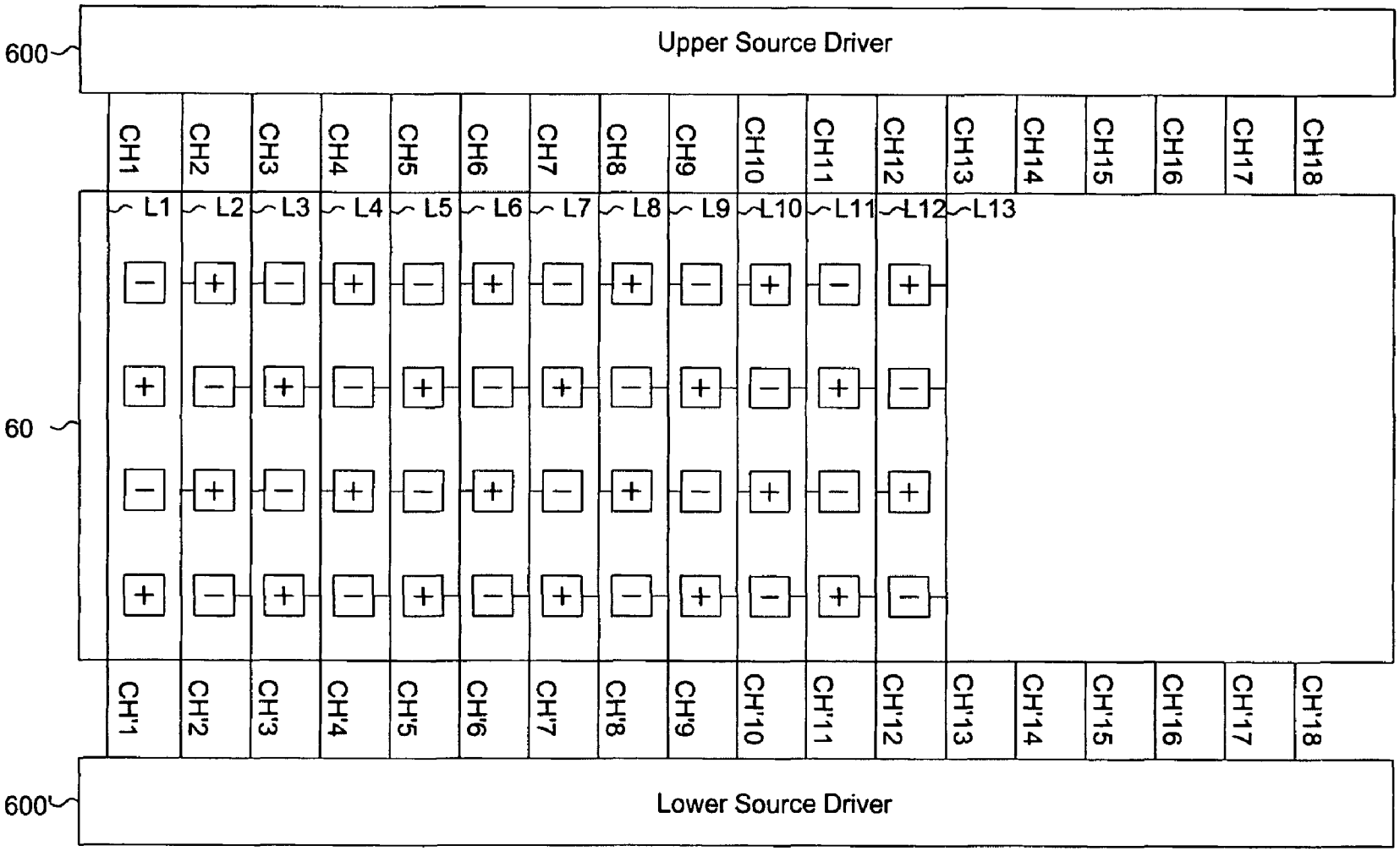
FIG. 6 is an exemplary schematic diagram illustrating a Z-inversion type display panel in accordance with an embodiment.

FIG. 6 is an exemplary schematic diagram illustrating the connections of the output channels with pixels on a Z-inversion type display panel in accordance with one embodiment. The Z-inversion type display panel can preferably be driven according to a so-called column inversion method to appear to be driven according to a dot inversion method and therefore surpass the first embodiment in power consumption saving.

As shown, a display panel 60 includes a plurality of pixels connected to source lines L1-L(12N+1) (N is 1 for example) that are connected to a plurality of pixels according to a conventional Z-inversion connection pattern. As shown, pixels on the same column are connected alternatively to one of two neighboring source lines. Additionally, the source lines L1-L13 are driven by a plurality of output channels 'CH1'-'CH13' of a multimode source driver 600, respectively, and also by a plurality of output channels 'CH'18'-'CH'6' of another multimode source driver 600', respectively. Additionally, dummy output channels CH14-CH18 of the multimode source driver 600 and CH'1-CH'5 of the multimode source driver 600' are required without being connected to any source lines such that both multimode source drivers 600 and 600' can both operate in the output modes AAAA, AABB, ABAB.

Figure 7A:
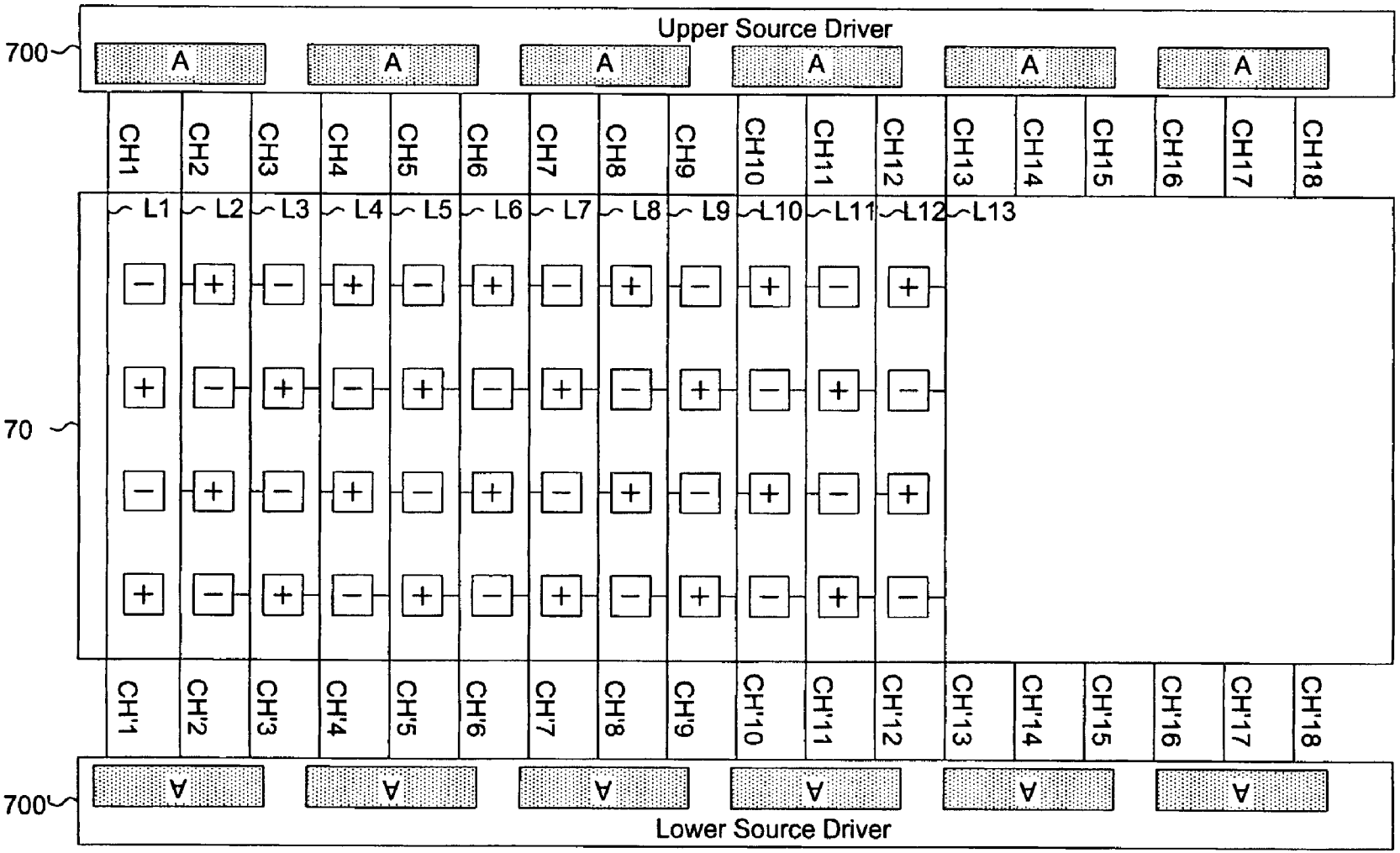
FIGS. 7A-7C are schematic diagrams of a display device that employs two "12N+6"-type multimode source drivers of FIG. 1 operating in different output modes in accordance with an embodiment.
Figure 7B:
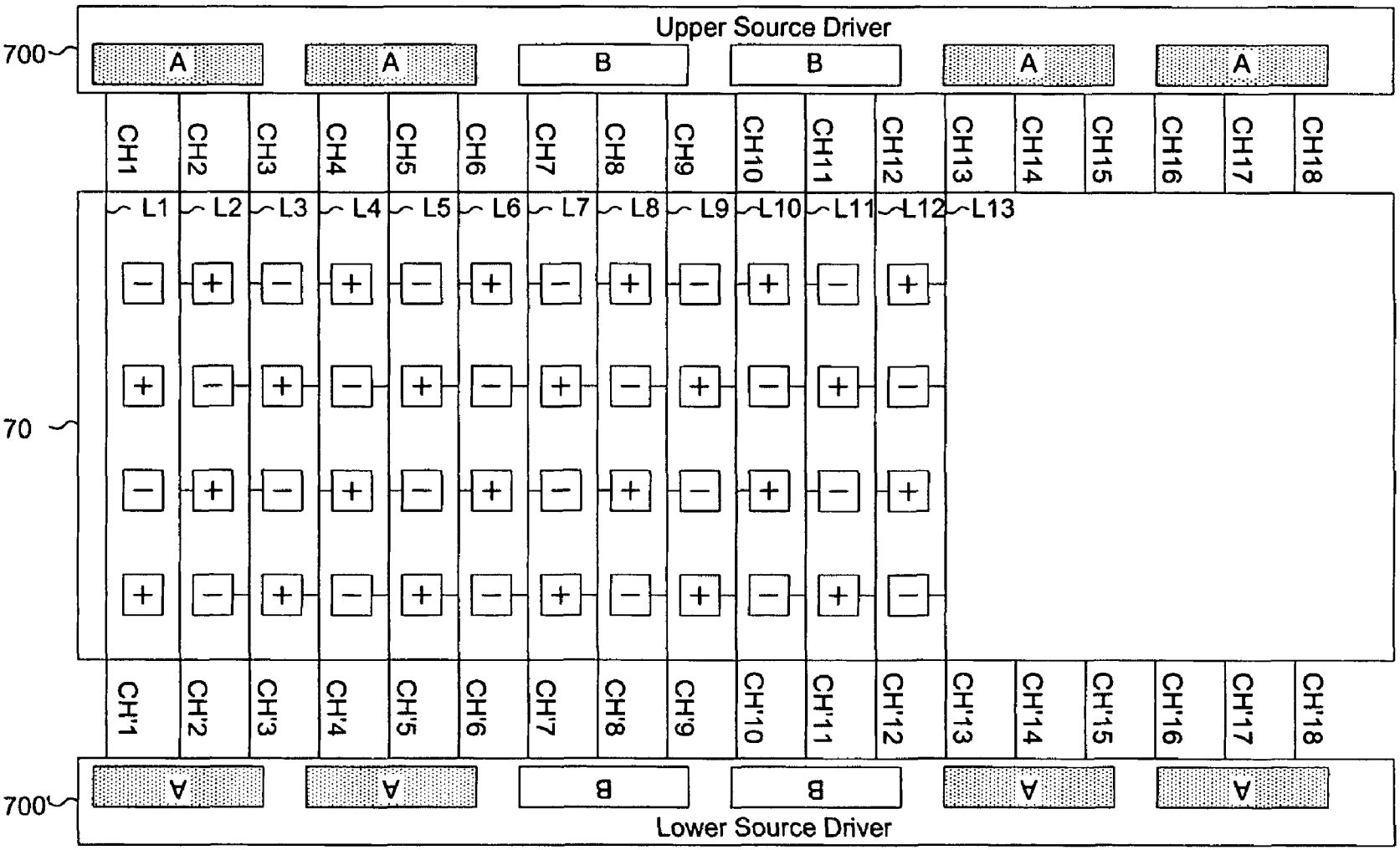
Figure 7C:
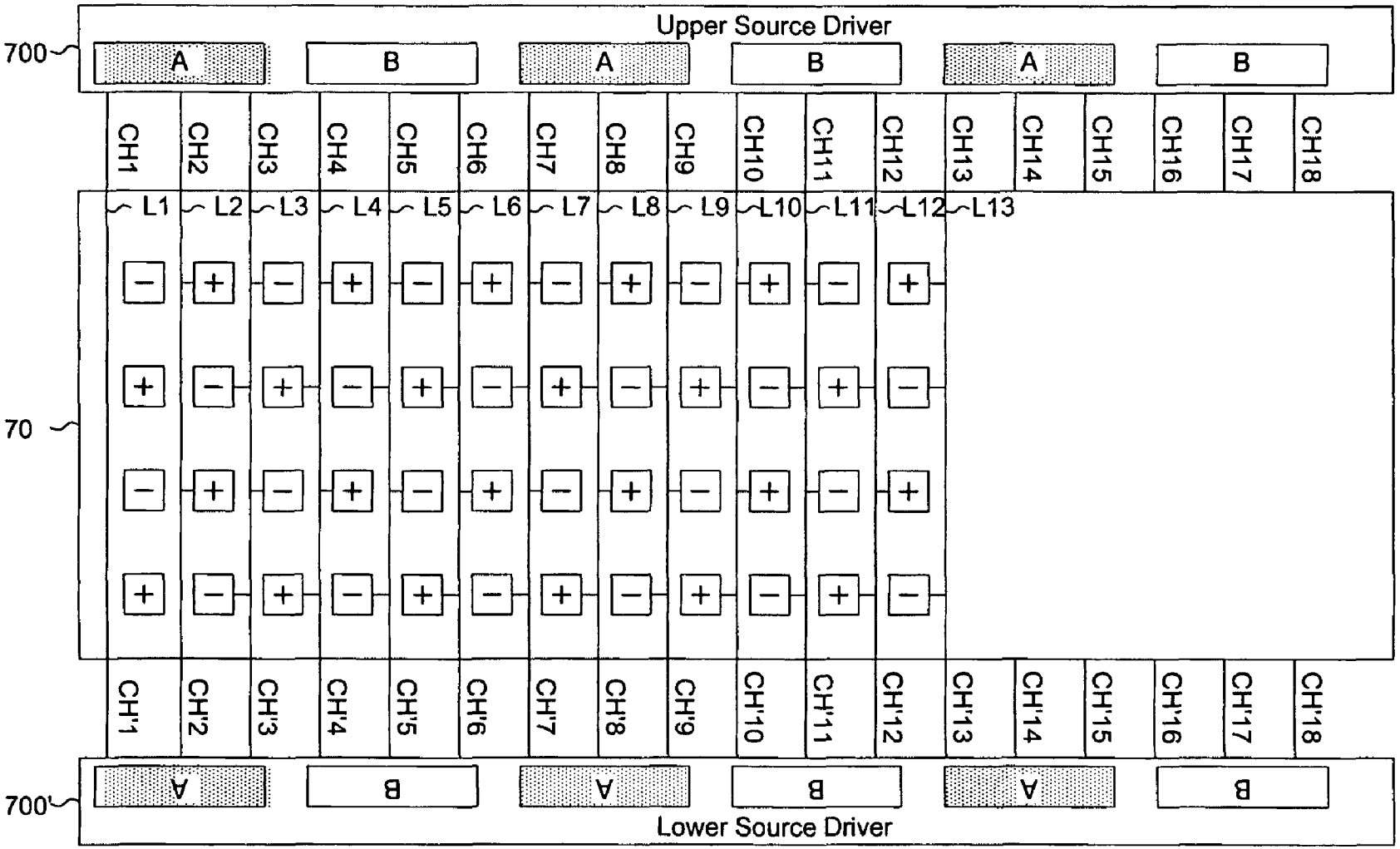

FIGS. 7A-7C are schematic diagrams of a display device that employs two "12N+6"-type multimode source drivers of FIG. 1 operating in different output modes in accordance with an embodiment, where N is 1 for example. In FIGS. 7A-7C, a display device includes a "Z-inversion"-type display panel 70, and two multimode source drivers 700 and 700' that are disposed on two sides of the display panel 70.

As shown in FIG. 7A, the multimode source driver 700 and 700' both operate in output mode AAAA, as is similar to the '12N' case shown in FIG. 2A.

As shown in FIG. 7B, the multimode source driver 700 operates in output mode AABB, and the multimode source driver 700' operates in output mode AABB rather than output mode BBAA in the '12N' case shown in FIG. 2B, such that each source line can be provided by the multimode source drivers 700 and 700' with pixel data transmitted from the same data bus (i.e. the first data bus 'BUSA' or the second data bus 'BUSB' in FIG. 1).

As shown in FIG. 7C, the multimode source driver 700 operates in output mode ABAB, while the multimode source driver 700' operates in output mode BABA, as is similar to the '12N' case shown in FIG. 2C, such that each source line can be provided by the multimode source drivers 700 and 700' with pixel data transmitted from the same data bus (i.e. the first data bus 'BUSA' or the second data bus 'BUSB' in FIG. 1).

Figure 8A:
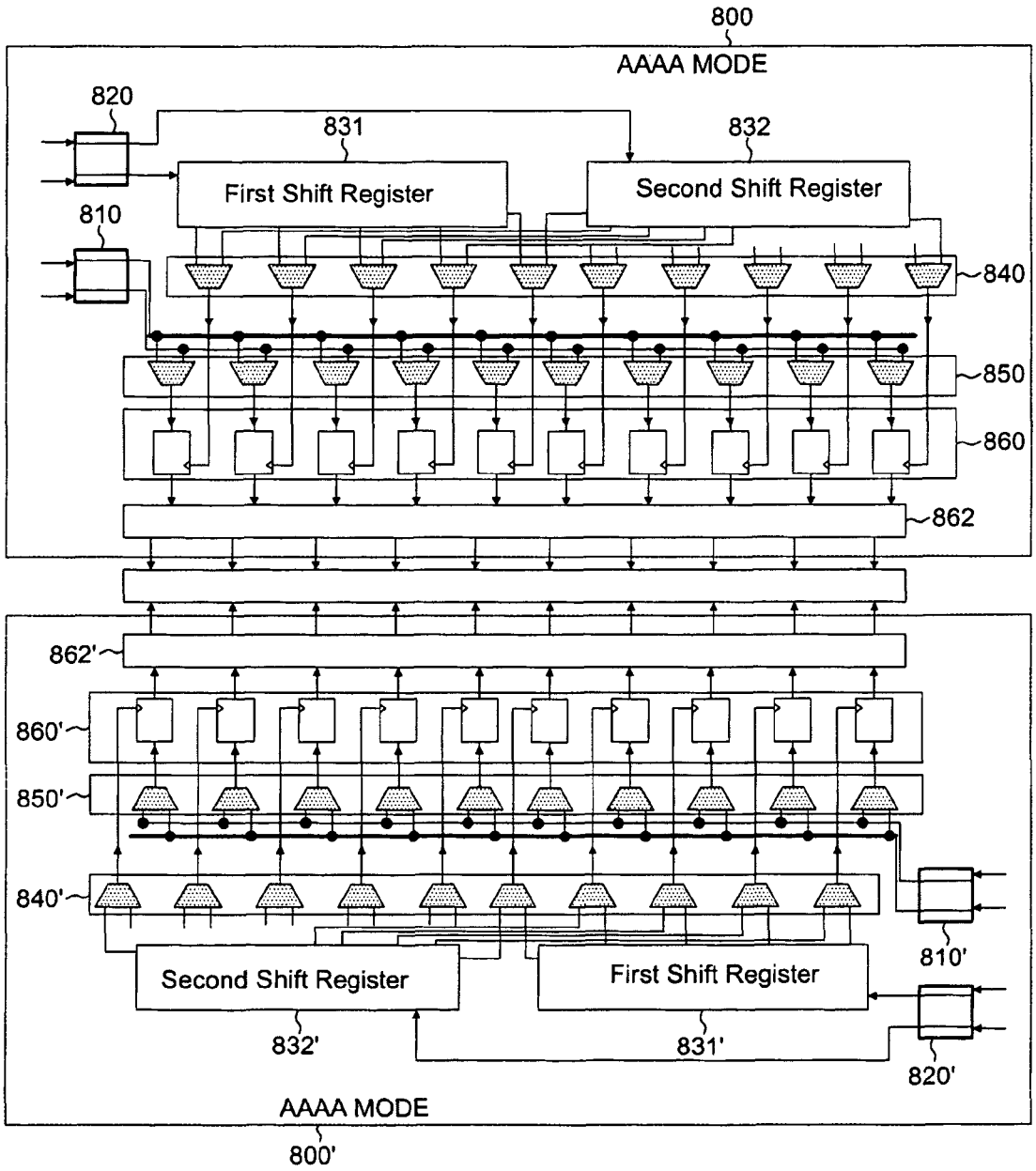
FIGS. 8A-8C are exemplary diagrams illustrating the detailed operation of the two multimode source drivers corresponding to FIGS. 7A-7C, respectively, in accordance with one embodiment.
Figure 8B:
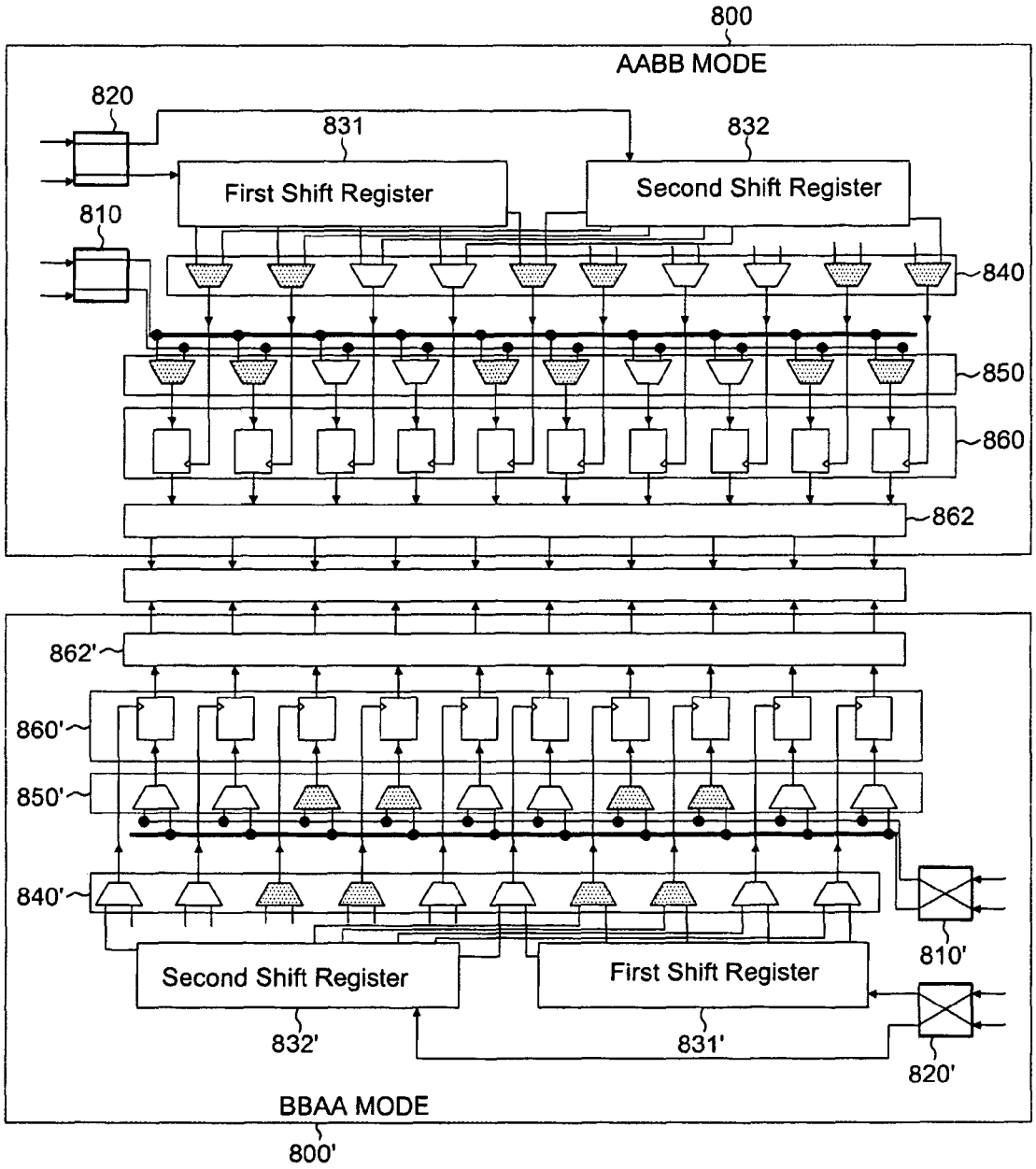
Figure 8C:
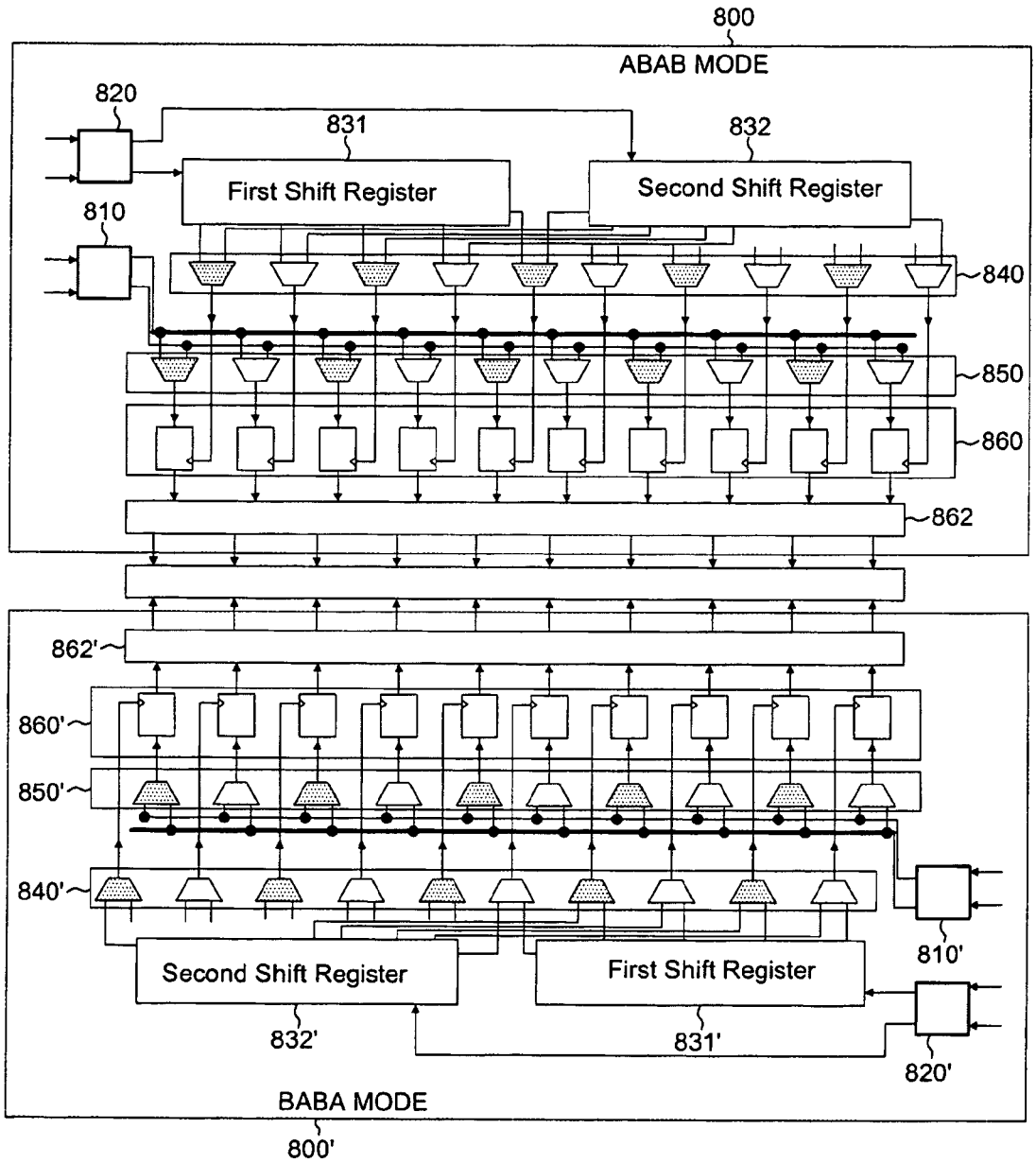

FIGS. 8A-8C are exemplary diagrams illustrating the detailed operation of the two multimode source drivers corresponding to FIGS. 7A-7C, respectively, in accordance with one embodiment where n=10, m=n*3=30, and therefore m=6*4+6 (i.e., N=4).

In the illustrative embodiment of FIG. 8A-8C, output units are omitted for clearer illustration purpose. Additionally, multiplexers within a shift multiplexer 840 are drawn gray and white to represent they transmit latch signals SR1 and SR2, respectively. Additionally, latch multiplexers 850 are drawn gray and white to represent they transmit pixel data from internal bus 'BUS1' and 'BUS2', respectively.

FIG. 9 is a table that summarizes the output modes of the multimode source drivers and the corresponding states of the swapping control signals and the mode control signals for FIGS. 7A-7C and FIGS. 8A-8C.

Figure 9A:
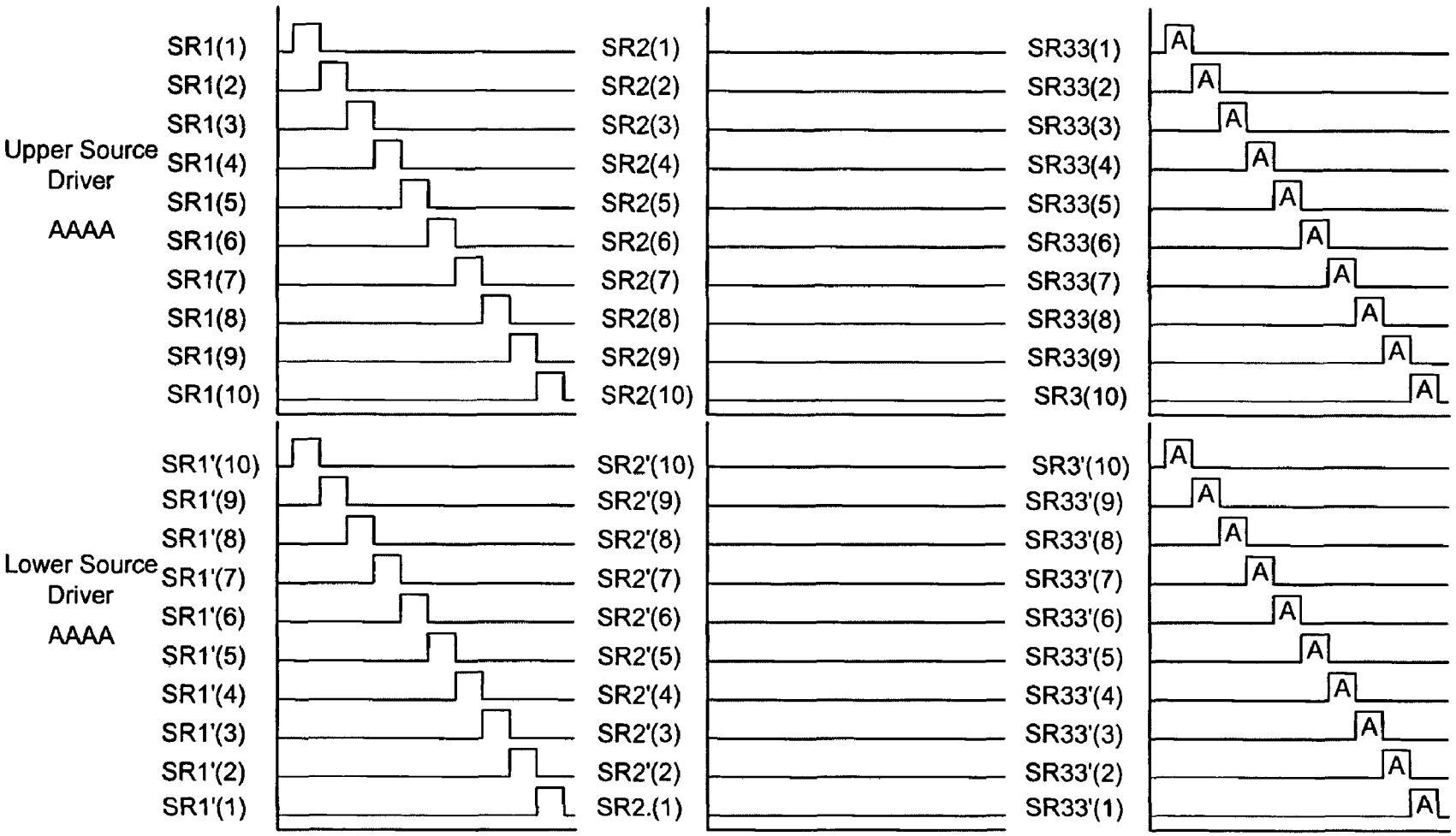
FIGS. 9A-9C are exemplary timing diagrams illustrating the waveforms of typical latch signals in FIGS. 3A-3C, respectively, in accordance with one embodiment.

In FIGS. 8A, 9A, and 10, the multimode source drivers 800 and 800', both operating in output modes AAAA, receive the swapping control signals 'SC_W' and "SC'_W' that are both '0' and the mode control signals 'SC_M' and 'SC'_M' that are both '(0, 0, 0, 0)', as is similar to the '12N'-type' case in FIGS. 2A and 3A.

Referring particularly to FIG. 9A, the first series of latch signals SR1(1)-SR1(10) are sequentially turned on, while the second series of latch signals SR2(1)-SR2(10) are continuously maintained low, which are then selectively transmitted by the mode control signals 'SC'_M' '(0, 0, 0, 0)' to provide the third series of latch signals SR3(1)-SR3(10) that are turned on in a sequence as SR3(1)=SR1(1)→SR3(2)=SR1(2)→SR3(3)=SR1(3)→ . . . →SR3(10)=SR1(10). On the other hand, SR1'(*i*)=SR1(10-*i*+1), SR2'(*i*)=SR2(10-*i*+1), and SR'(i)=SR3(10-*i*+1), such that each source line of the display panel can be driven by the multimode source drivers 800 and 800' at the same timing.

Figure 9B:
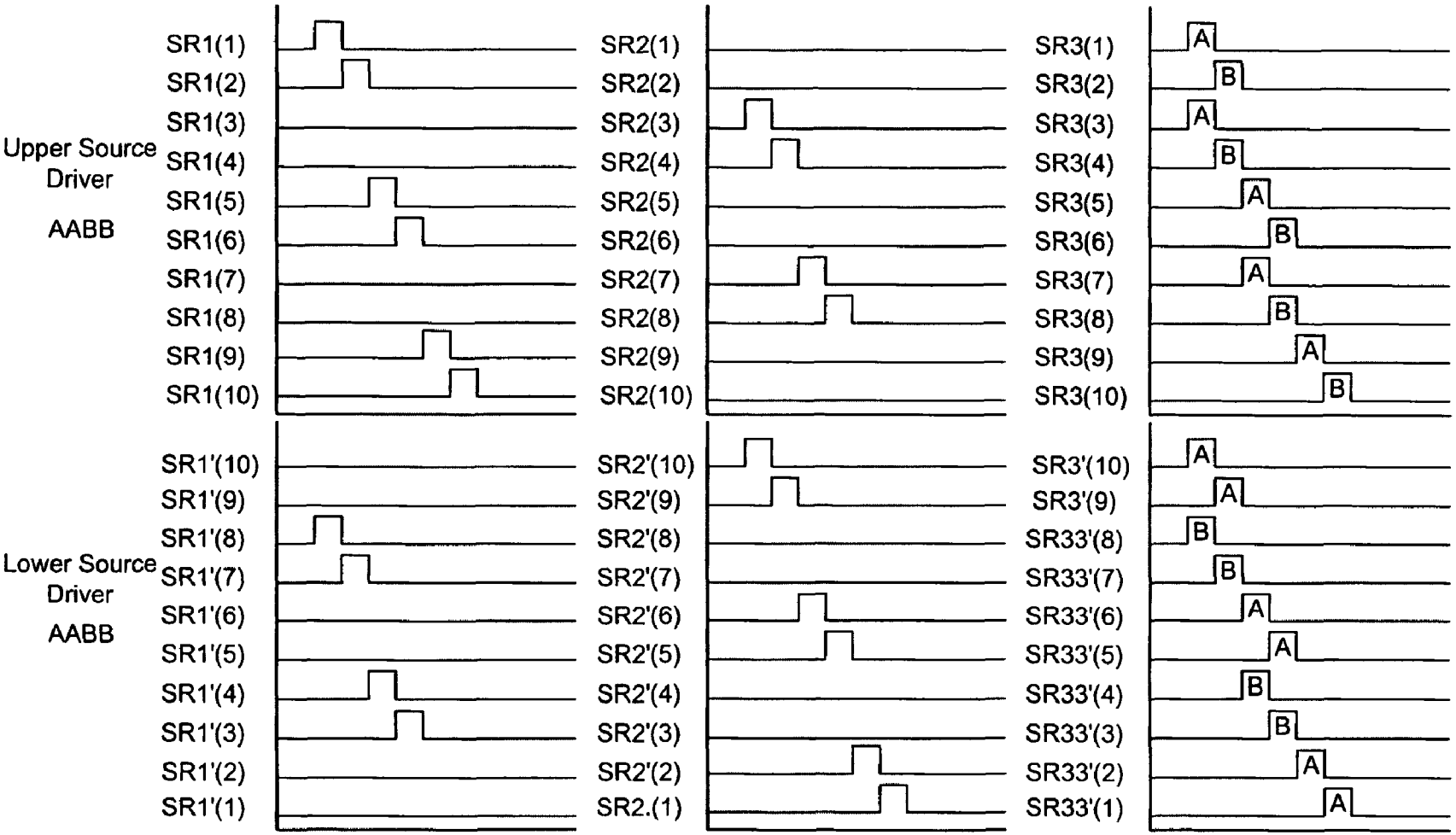

In FIGS. 8B, 9B, and 10, the multimode source drivers 800 and 800', respectively operating in the output modes AABB and BBAA, receive the swapping control signals 'SC_W' and "SC'_W' that are '0' and '1', respectively, and the mode control signals 'SC'_M' and 'SC'_M' that are '(0, 0, 1, 1)' and '(1, 1, 0, 0)', respectively. It is noted that the mode control signals 'SC'_M' and 'SC'_M' in this '12N+6'-type embodiment are identical to those in the '12N'-type embodiment (FIGS. 2B and 3B), while the swapping control signals 'SC_W' and "SC'_W' in this '12N+6'-type embodiment are therefore different from those in the '12N'-type embodiment. As can be seen in comparison of FIGS. 3B and 8B, the implementation of the bus swapping circuit and the start pulse swapping circuit, which make the pixel data and the start pulses input from the timing controller swappable, can allow the mode control signals 'SC'_M' and 'SC'_M' to be identical in the '12N+6'-type and the '12N'-type embodiments. Accordingly, the multimode source drivers can have a simple control mechanism.

Referring particularly to FIG. 9B, the first and second series of latch signals SR1(1)-SR1(10) and SR2(1)-SR2(10) are turned on in a sequence as: SR1(1) and SR2(3) both on→SR1(2) and SR2(4) both on→SR1(5) and SR2(7) both on→SR1(6) and SR2(8) both on→SR1(9) on→SR1(10) on, which are then selectively transmitted according to the mode control signals 'SC'_M' '(0, 0, 1, 1)' to provide the third series of latch signals SR1(1)-SR1(8) that are turned on in a sequence as SR3(1)=SR1(1) and SR3(3)=SR2(1) both on→SR3(2)=SR1(2) and SR3(4)=SR2(4) both on→SR3(5)=SR1(5) and SR3(7)=SR2(7) both on→SR3(6)=SR1(6) and SR3(8)=SR2(8) both on→SR3(9)=SR1(9) on→SR3(10)=SR1(10) on. On the other hand, the latch signals SR2'(1)-SR2'(10) and SR1(1)-SR1(10) have opposite sequences, and the latch signals SR1'(1)-SR1'(10) and SR2(1)-SR2(10) have opposite sequences. Consequently, the third series of latch signals SR3(1)-SR3(10) and SR3'(1)-SR3'(10) have opposite sequences, which cause each source line of the display panel to be driven at the same timing.

Figure 11:
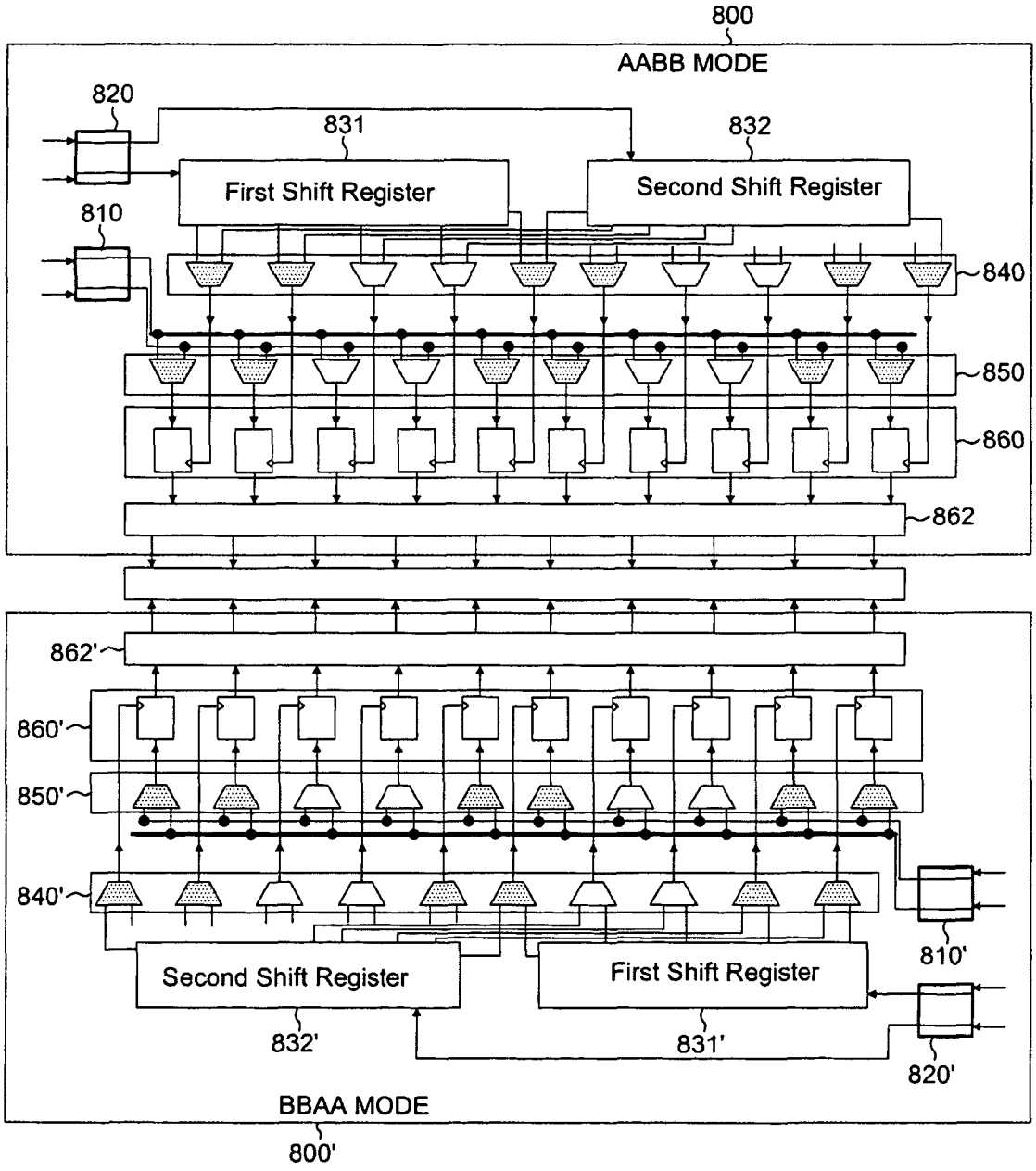
FIG. 11 is an exemplary diagram illustrating the detailed operation of the two multimode source drivers corresponding to FIG. 7B in accordance with another embodiment.
Figure 12:
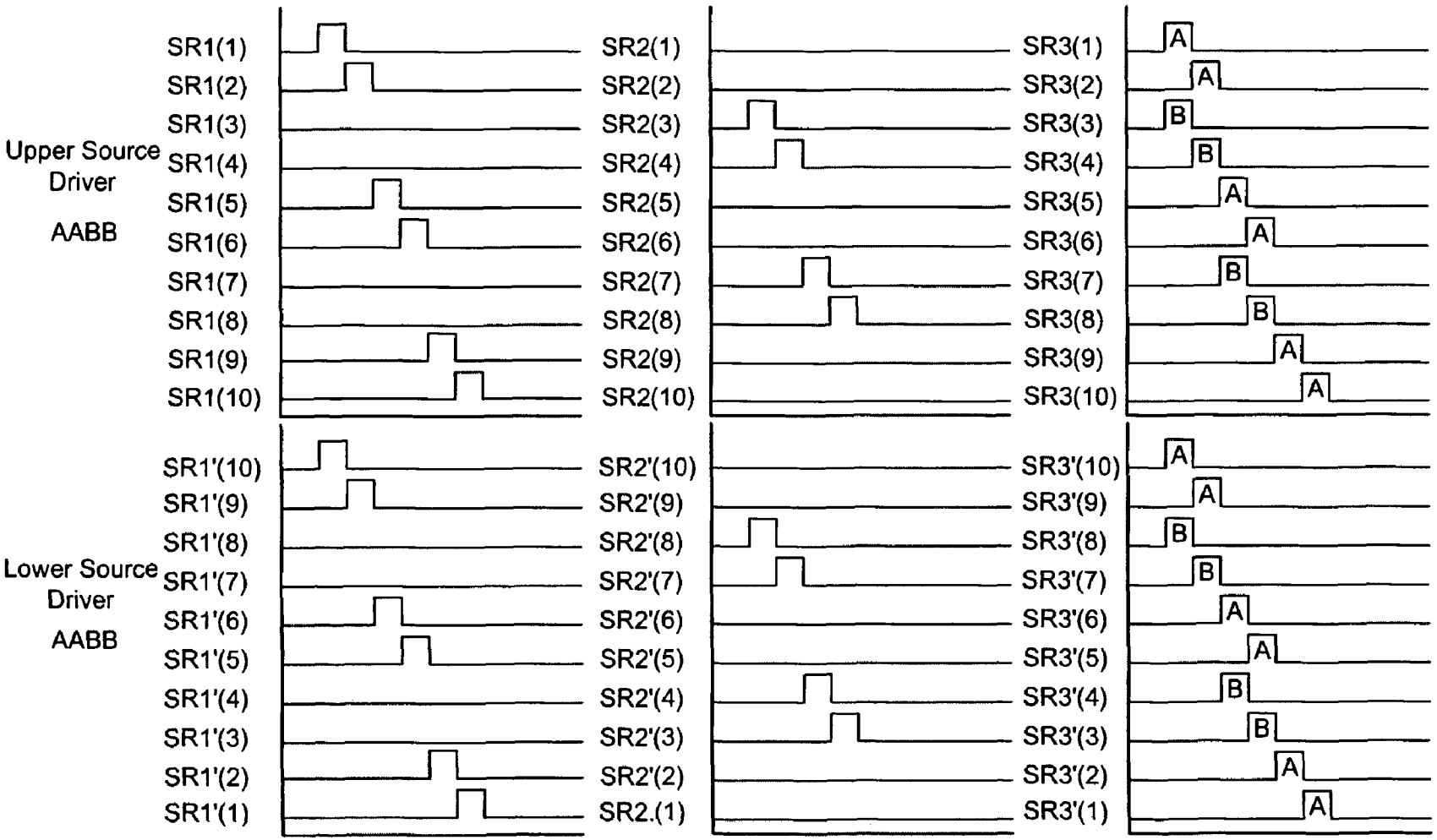
FIG. 12 is an exemplary timing diagram illustrating the waveforms of typical latch signals in FIG. 11 in accordance with one embodiment.

Alternatively, the configuration shown in FIG. 7B can also be implemented according to another embodiment shown in FIGS. 11 and 12.

FIG. 11 is an exemplary diagram illustrating the detailed operation of the two multimode source drivers corresponding to FIG. 7B in accordance with an alternative embodiment. FIG. 12 is an exemplary timing diagram illustrating the waveforms of typical latch signals in FIG. 11 in accordance with one embodiment.

In FIGS. 11 and 12, in contrary to FIGS. 8B and 9B, the multimode source drivers 800 and 800', respectively operating in the output modes AABB and BBAA, receive the swapping control signals 'SC_W' and "SC'_W' that are both '0', respectively, and the mode control signals 'SC'_M' and 'SC'_M' that are both '(0, 0, 1, 1)'. It is noted that the mode control signals 'SC'_M' and 'SC'_M' and the swapping control signals 'SC_W' and "SC'_W' in this '12N+6'-type embodiment are both different from those in the '12N'-type embodiment. As can be seen in comparison of FIGS. 8B and 11, the implementation of the bus swapping circuit and the start pulse swapping circuit, which make the pixel data and the start pulses input from the timing controller swappable, can allow the mode control signals and the swapping control signals to be different in the configuration of FIG. 7. Accordingly, the multimode source drivers can have a flexible control mechanism.

Referring particularly to FIG. 12, the first and second series of latch signals SR1(1)-SR1(10) and SR2(1)-SR2(10) and the third series of latch signals SR1(1)-SR1(8) are turned on in a sequence similar to that shown in FIG. 9B. On the other hand, SR1'(*i*)=SR1(10-*i*+1), SR2'(*i*)=SR2(10-*i*+1), and therefore SR'(i)=SR3(10-*i*+1), such that each source line of the display panel can be driven by the multimode source drivers 800 and 800' at the same timing.

Figure 9C:
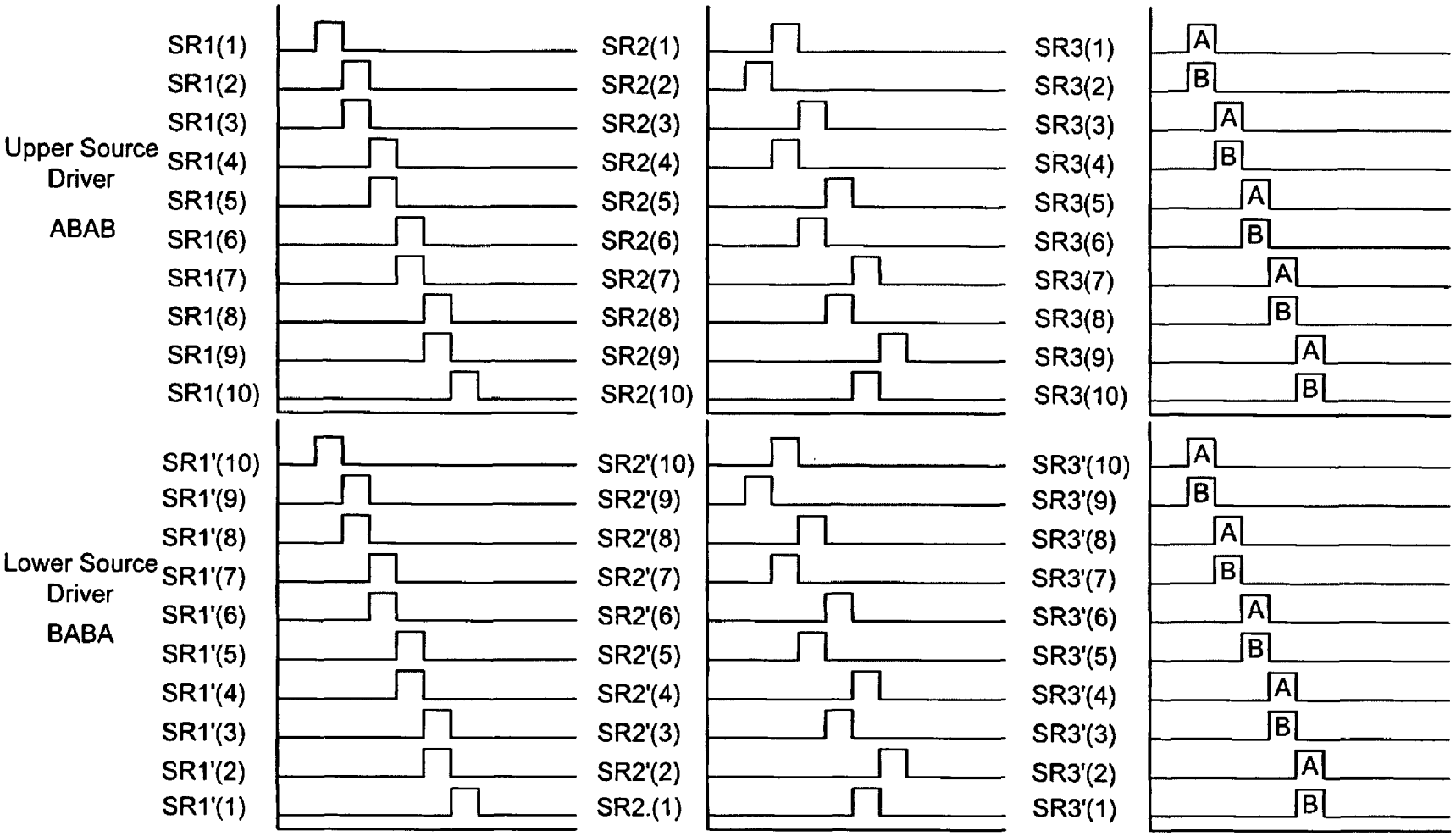

In FIGS. 8C, 9C, and 10, the multimode source drivers 800 and 800', respectively operating in output modes ABAB and BABA, receive the swapping control signals 'SC_W' and "SC'_W' that are both '0' and the mode control signals 'SC'_M' and 'SC'_M' that are '(0, 1, 0, 1)' and '(1,0,1,0)', respectively, as is similar to the '12N'-type' case in FIGS. 2C and 3C.

Referring particularly to FIG. 9C, the first and second series of latch signals SR1(1)-SR1(10) and SR2(1)-SR2(10) are turned on in a sequence as: SR1(1) and SR2(2) both on→SR1(2), SR1(3), SR2(1), and SR2(4) all on→SR1(4), SR1(5), SR2(3), and SR2(6) all on→SR1(6), SR1(7), SR2(5), and SR2(8) all on→SR1(8), SR1(9), SR2(7), and SR2(10)→SR1(10) and SR2(9) both on, which are then selectively transmitted according to the mode control signals 'SC'_M' '(0, 1, 0, 1)' to provide the third series of latch signals SR1(1)-SR1(8) that are turned on in a sequence as SR3(1)=SR1(1) and SR3(2)=SR2(2) both on→SR3(3)=SR1(3) and SR3(4)=SR2(4) both on→SR3(5)=SR1(5) and SR3(6)=SR2(6) both on→SR3(7)=SR1(7) and SR3(8)=SR2(8) both on→SR3(9)=SR1(9) and SR3(10)=SR2(10) both on. On the other hand, SR1'(*i*)=SR1(10-*i*+1), SR2'(*i*)=SR2'(10-*i*+1), and therefore SR'(i)=SR3(10-*i*+1), such that each source line of the display panel can be driven by the multimode source drivers 800 and 800' at the same timing.

In summary, the multimode source drivers of the embodiments can re-arrange the sequence of the pixel data input from the timing controller in different ways so as to provide the driving voltages according to different output modes. The multimode source drivers have been shown to have high adaptability to various display panel types that may have specific line connection patterns and require to be driven by different number of output channels, thus able to accomplish desired advantages of those different display panel types. Moreover, the multimode source drivers of the embodiments having different numbers of output channels to drive different display panel types, as illustrated by embodiments of FIGS. 2A-2C and FIGS. 7A-7C, can operate with comparable output modes (e.g. modes 'AAAA', 'AABB', and 'ABAB'). Particularly, dual multimode source drives having (12N+6) output channels, if operating in appropriate output mode combinations, can cooperate to drive a Z-inversion type display panel and therefore have reduced power consumption. Moreover, the implementation of the bus swapping circuit and the start pulse swapping circuit allows the pixel data and the start pulses input from the timing controller to be swappable, thus providing a simple and flexible control mechanism for the multimode source driver, as described for the embodiments of FIGS. 3B, 8B, and 11.

While certain embodiments have been described above, it will be understood that the embodiments described are by way of example only. Accordingly, the device and methods described herein should not be limited based on the described embodiments. Rather, the device and methods described herein should only be limited in light of the claims that follow when taken in conjunction with the above description and accompanying drawings.

What is claimed is:

1. A multimode source driver connected to a first data bus and a second data bus for driving a display device, comprising:

a bus swapping circuit operable according to a swapping control signal to selectively connect the first data bus to either one of a first internal bus and a second internal bus, and the second data bus to the other one of the first internal bus and the second internal bus;

a start pulse swapping circuit, receiving a first start pulse and a second start pulse, and outputting a first swap start pulse and a second swap start pulse, wherein the start pulse swapping circuit is operable according to the swapping control signal to output the first start pulse as the first swap start pulse and the second start pulse as the second swap start pulse, or to output the second start pulse as the first swap start pulse and the first start pulse as the second swap start pulse;

a first shift register, triggered by the first swap start pulse to generate a first series of latch signals;

a second shift register, triggered by the second swap start pulse to generate a second series of latch signals;

a shift multiplexer, receiving the first series of latch signals and the second series of latch signals, and outputting a third series of latch signals selected among the first series of latch signals and the second series of latch signals;

a plurality of latch multiplexers, each of the latch multiplexers being coupled to the first internal bus and the second internal bus, and each of the latch multiplexers being configured to selectively transmit pixel data from either of the first internal bus and the second internal bus according to a mode control signal;

a plurality of latch units controlled by the third series of latch signals to latch the pixel data from the latch multiplexers; and an output unit configured to provide a plurality of driving voltages according to the pixel data from the latch units.

2. The multimode source driver of claim 1, wherein the shift multiplexer and the first and second shift registers are controlled by the mode control signal.

3. The multimode source driver of claim 1, wherein the multimode source driver is set by the mode control signal and the swapping control signal to selectively operate in one of a plurality of output modes.

4. The multimode source driver of claim 3, wherein the multimode source driver is operable according to the output mode to transfer to each of a plurality of channel groups either of pixel data received from the first data bus and pixel data received from the second data bus.

5. The multimode source driver of claim 4, wherein the output modes include $M_1M_2M_3M_4$=AAAA, AABB, and BBAA modes, wherein the multimode source driver provides pixel data received from the first and second data buses to the $i^{th}$ one of the channel groups when Mi=A and Mi=B, respectively, wherein i=1~4.

6. The multimode source driver of claim 1, wherein the output unit has 12N output channels, wherein N is a non-zero integer.

7. The multimode source driver of claim 1, wherein the output unit has (12N+6) output channels, wherein N is a non-zero integer.

8. The multimode source driver of claim 1, wherein the multimode source driver is coupled to drive a Z-inversion display panel.

9. A display device comprising:

a display panel;

a first multimode source driver configured as the multimode source driver of claim 1, the first multimode source driver being connected with the display panel at a first side of the display panel; and a second multimode source driver configured as the multimode source driver of claim 1, the second multimode source driver being connected with the display panel at a second side of the display panel.

10. The display device of claim 9, wherein the shift multiplexer and the first and second shift registers are controlled by the mode control signal in each of the first and second multimode source drivers.

11. The display device of claim 9, wherein each of the first and second multimode source drivers is set by the respective mode control signal and the respective swapping control signal to selectively operate in one of a plurality of output modes.

12. The display device of claim 11, wherein each of the first and second multimode source drivers is operable according to the output mode to transfer to each of a plurality of channel groups either of pixel data received from the first data bus and pixel data received from the second data bus.

13. The display device of claim 12, wherein the output modes for each of the first and second multimode source drivers include $M_1M_2M_3M_4$=AAAA, AABB, and BBAA modes, wherein each of the first and second multimode source drivers provides pixel data received from the first and second data buses to the $i^{th}$ one of the channel groups when Mi=A and Mi=B, respectively, wherein i=1~4.

14. The display device of claim 9, wherein the output unit in each of the first and second multimode source drivers has 12N output channels, wherein N is a non-zero integer.

15. The display device of claim 14, wherein when the first multimode source driver operates in AAAA, AABB, and ABAB modes, the second multimode source driver operates in AAAA, BBAA, and BABA modes, respectively.

16. The display device of claim 9, wherein the output unit in each of the first and second multimode source drivers has (12N+6) output channels, wherein N is a non-zero integer.

17. The display device of claim 16, wherein when the first multimode source driver operates in AAAA, AABB, and ABAB modes, the second multimode source driver operates in AAAA, AABB, and BABA modes, respectively.

18. The display device of claim 17, wherein the display panel is a Z-inversion display panel.

* * * * *